US008695857B2

(12) United States Patent
Hamamoto et al.

(10) Patent No.: US 8,695,857 B2
(45) Date of Patent: Apr. 15, 2014

(54) CAP AND CONTAINER WITH CAP

(75) Inventors: Keiji Hamamoto, Ibaraki (JP); Hideo Nishikura, Ibaraki (JP)

(73) Assignee: Taisei Kako Co., Ltd. (JP)

( * ) Notice: Subject to any disclaimer, the term of this patent is extended or adjusted under 35 U.S.C. 154(b) by 0 days.

(21) Appl. No.: 13/203,177

(22) PCT Filed: Feb. 26, 2010

(86) PCT No.: PCT/JP2010/053119

§ 371 (c)(1),
(2), (4) Date: Aug. 24, 2011

(87) PCT Pub. No.: WO2010/098453

PCT Pub. Date: Sep. 2, 2010

(65) Prior Publication Data

US 2011/0303668 A1 Dec. 15, 2011

(30) Foreign Application Priority Data

Feb. 27, 2009 (JP) ..... 2009-046570
Feb. 26, 2010 (JP) ..... 2010-041346

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 47/00*** | (2006.01) |
| ***B67D 3/00*** | (2006.01) |
| ***B67D 7/06*** | (2010.01) |
| ***B65D 39/00*** | (2006.01) |
| ***B65D 41/00*** | (2006.01) |
| ***B65D 43/00*** | (2006.01) |
| ***B65D 51/00*** | (2006.01) |
| ***B65D 43/24*** | (2006.01) |
| ***B65D 43/16*** | (2006.01) |

(52) U.S. Cl.
USPC ..... 222/498; 222/556; 222/517; 215/235; 220/831; 220/832

(58) Field of Classification Search
USPC ..... 222/556, 544, 498, 563, 515, 517, 546; 220/831, 852, 375, 306; 215/335, 306, 215/237, 153.11, 153.06
See application file for complete search history.

(56) References Cited

U.S. PATENT DOCUMENTS

| | | | | | |
|---|---|---|---|---|---|
| 4,298,146 | A | * | 11/1981 | Montgomery | 222/536 |
| 4,713,219 | A | * | 12/1987 | Gerken et al. | 422/547 |
| 5,169,035 | A | * | 12/1992 | Imbery, Jr. | 222/212 |
| 5,573,127 | A | * | 11/1996 | Takahashi et al. | 215/237 |
| 5,601,214 | A | * | 2/1997 | Hendrickson et al. | 222/517 |
| 5,735,438 | A | * | 4/1998 | Ostrowsky | 222/153.06 |
| 5,769,253 | A | * | 6/1998 | Gross | 215/237 |
| 6,460,726 | B1 | * | 10/2002 | Hierzer et al. | 220/838 |
| 6,575,330 | B2 | * | 6/2003 | Rousselet | 222/1 |

FOREIGN PATENT DOCUMENTS

| | | | |
|---|---|---|---|
| CA | 1134324 | | 10/1982 |
| EP | 0024801 | | 3/1981 |
| EP | 0345403 | | 12/1989 |
| JP | 56-32249 | | 4/1981 |
| JP | 56-141159 | | 10/1981 |
| JP | 56 141159 U | * | 10/1981 |
| JP | 62-38927 | | 10/1987 |
| JP | 62-171452 | | 10/1987 |
| JP | 63-6048 | | 2/1988 |
| JP | 63-175047 | | 11/1988 |
| JP | 3016863 | | 3/2000 |
| WO | WO98/55371 | | 12/1998 |

OTHER PUBLICATIONS

European Search Report issued Jun. 6, 2012 in connection with European Patent Appl. No. 10746332.5.
Japanese Office Action dated Dec. 7, 2012 issued in connection with corresponding Japanese Patent Application No. 2009-046570.
Japanese Office Action dated Dec. 7, 2012 issued in connection with corresponding Japanese Patent Application No. 2010-041346.

* cited by examiner

*Primary Examiner* — Paul R Durand
*Assistant Examiner* — Benjamin R Shaw
(74) *Attorney, Agent, or Firm* — Berliner & Associates

(57) ABSTRACT

An object is to provide a cap that can be flexibly designed, such as a cap that can be prevented or reduced from being increased in volume when the lid member has been attached to the cap body, while at the same time providing a capability to increase the distance between the lid member and the cap body when the elastic member has been restored, as well as providing a container equipped with the cap. Provided is a cap and a container with a cap, which includes a cap body (10), a lid member (20), an elastic member (30) that couples the lid member (20) to the cap body (10), and a coupling member (40) that couples the lid member (20) to the cap body (10), in which: the elastic member (30), which has been elastically deformed, is restored during at least part of the movement of the lid member (20) away from the cap body (10), thereby enabling the lid member (20) to be held away from the cap body (10); and the coupling member (40) is connected to the cap body (10) via a first hinge mechanism (41) and connected to the lid member (20) via a second hinge mechanism (42) that has an axis parallel to an axis of the first hinge mechanism (41).

7 Claims, 28 Drawing Sheets

CAP AND CONTAINER WITH CAP

TECHNICAL FIELD

The present invention relates to a cap that includes a cap body, a lid member and an elastic member coupling the lid member to the cap body and is configured so that the lid member can be moved away from the cap body, and a container with the cap.

FIELD OF THE INVENTION

As a cap equipped with a cap body and a lid member attached to and detached from the cap body, there is hitherto known a cap configured so that the lid member can be moved away from the cap body by an elastic member that couples the lid member to the cap body (e.g., Patent Document 1). In this cap, the cap body and the lid member have radially projecting pieces, respectively, which are connected to each other with a hinge mechanism.

When the lid member has been attached to the cap body, the elastic member is elastically deformed, and when the lid member has been detached from the cap body, the lid member is pivotally moved by restoration of the elastic member and is thereby moved away from the cap body. Thus, the lid member is held at a position away from the cap body.

PRIOR ART DOCUMENTS

Patent Documents

Patent Document 1: Japanese Utility Model Application Laid-open No. Sho-63-175047

DISCLOSURE OF THE INVENTION

Problems to be Solved by the Invention

Meanwhile, in order to increase the distance between the lid member and the cap body when the elastic member has been restored in the aforesaid cap, it is necessary to design the projecting pieces of the cap body and the lid member to have an increased projecting amount to be adapted to the increased distance. Accordingly, in order to increase the distance between the lid member and the cap body, the projecting pieces necessarily greatly project when the lid member has been attached to the cap body, which causes design limitation, such as the necessity to increase the volume of the cap.

In consideration of the above reason, it is an object of the present invention to provide a cap that can be flexibly designed, such as a cap that can be prevented or reduced from being increased in volume when the lid member has been attached to the cap body, while at the same time providing a capability to increase the distance between the lid member and the cap body when the elastic member has been restored, as well as providing a container equipped with the cap.

Means for Solving the Problem

According to the present invention, there is provided a cap, which includes a cap body that is fixed to a container and has a pour spout opening, through which content of the container is poured out, a lid member that is attached to and detached from the cap body to open and close the pour spout opening, and an elastic member that couples the lid member to the cap body, wherein:

the elastic member, which has been elastically deformed, is restored during at least part of the movement of the lid member away from the cap body, thereby enabling the lid member to be held away from the cap body;

the cap further comprising a coupling member that couples the lid member to the cap body, the coupling member being connected to the cap body via a first hinge mechanism and connected to the lid member via a second hinge mechanism that has an axis parallel to an axis of the first hinge mechanism.

According to the cap of the present invention, the coupling member, which couples the lid member to the cap body, is connected to the cap body via the first hinge mechanism. Thus, when the coupling member is pivotally moved by the first hinge mechanism, the coupling member and the lid member are integrally moved toward and away from the cap body. Also, the coupling member is connected to the lid member via the second hinge mechanism that has an axis parallel to an axis of the first hinge mechanism. Thus, when the lid member is pivotally moved by the second hinge mechanism, the lid member is moved toward and away from the cap body. Accordingly, for example, the cap may be configured so that, when the lid member has been attached to the cap body, the coupling member is held at a position close to the cap body.

In the cap of the present invention, it is possible to employ a configuration, in which the elastic member and the coupling member are disposed to have their ends, which are connected to the cap body, located away from each other in the direction orthogonal to the axial direction of the hinge mechanisms; and the elastic member is elastically deformed as the lid member is detached and moved away from the cap body, and restored when the elastic member is elastically deformed beyond a predetermined limit, thereby enabling the lid member to be held away from the cap body.

According to the cap having the above configuration, the elastic member and the coupling member are disposed to have their ends, which are connected to the cap body, located away from each other in the direction orthogonal to the axial direction of the hinge mechanisms. Whereby, the elastic member is elastically deformed as the lid member is detached from and moved away from the cap body. When the elastic member is elastically deformed beyond a predetermined limit, the elastic member is restored by elastic force to urge the lid member. Thus, the lid member can be held away from the cap body.

Also, according to the configuration, in which the ends of the elastic member and the coupling member connected to the cap body are located away from each other in the direction orthogonal to the axial direction of the hinge mechanisms, it is possible to stop the lid member from being pivotally moved by the first hinge mechanism with the elastic member restored. Whereby, the lid member can be held at a position at which the elastic member and the coupling member are balanced to each other.

In the cap of the present invention, it is possible to employ a configuration, in which the elastic member is connected to the cap body via a third hinge mechanism that has an axis parallel to the axis of the hinge mechanisms and connected to the lid member via a fourth hinge mechanism that has an axis parallel to an axis of the third hinge mechanism, in order to restrain the elastic member from being elastically deformed when the lid member has been attached to the cap body.

According to the cap having the above configuration, the elastic member is connected to the cap body via the third hinge mechanism that has an axis parallel to the axis of the hinge mechanisms and connected to the lid member via the fourth hinge mechanism that has an axis parallel to the axis of the third hinge mechanism. Whereby, it is possible to restrain the lid member from being elastically deformed when the lid member has been attached to the cap body.

In the cap of the present invention, the elastic member and the coupling member may be disposed to have their ends, which are connected to the lid member, located away from each other in the direction orthogonal to the axial direction of the hinge mechanisms.

According to the cap having the above configuration, the elastic member and the coupling member are disposed to have their ends, which are connected to the lid member, located away from each other in the direction orthogonal to the axial direction of the hinge mechanisms. Whereby, it is possible to stop the lid member from being pivotally moved by the second hinge mechanism with the elastic member restored. Whereby, the lid member can be held at a position at which the elastic member and the coupling member are balanced to each other.

The cap of the present invention may further include a pivotal movement restraining device that restrains the lid member from being moved close to the coupling member beyond a predetermined limit through pivotal movement by the second hinge mechanism in order to allow the lid member to be fixed at a predetermined position by the elastic member and the coupling member.

According to the cap, in which both ends of the elastic member and both ends of the coupling member are located away from each other, respectively, in the direction orthogonal to the axial direction of the hinge mechanisms, the lid member can be held at a position at which the elastic member and the coupling member are balanced to each other. In this respect, it is to be noted that there are plural positions at which the elastic member and the coupling member are balanced to each other. However, according to the thus configured cap, even when the lid member is forced to move close to the coupling member upon pivotal movement of the second hinge mechanism beyond a predetermined limit, the pivotal movement restraining device restrains this pivotal movement. Thus, the lid member can be held at a predetermined position of the plural positions at which the elastic member and the coupling member are balanced to each other.

In the cap of the present invention, the elastic member may be elastically deformed when the lid member has been attached to the cap body, and restored when the lid member has been detached from the cap body, thereby enabling the lid member to be held away from the cap body.

According to the cap having the above configuration, the elastic member is kept elastically deformed when the lid member has been attached to the cap body. When the lid member has been detached from the cap body, the elastic member is restored to urge the lid member. Thus, the lid member can be held away from the cap body.

In the cap of the present invention, the elastic member and the coupling member may be disposed to have their ends, which are connected to the cap body, located away from each other in the direction orthogonal to the axial direction of the hinge mechanisms.

According to the cap having the above configuration, the elastic member and the coupling member are disposed to have their ends, which are connected to the cap body, located away from each other in the direction orthogonal to the axial direction of the hinge mechanisms. Whereby, it is possible to stop the lid member from being pivotally moved and allow the lid member to be held at a position at which the elastic member and the coupling member are balanced to each other, while the elastic member has been restored.

In the cap of the present invention, the pour spout opening is disposed at a position close to a first end of the cap body, and the elastic member is connected to the cap body at a position closer to the first end of the cap body than the coupling member is.

According to the cap having the above configuration, the elastic member is connected to the cap body at a position closer to the first end of the cap body than the coupling member is, in which the cap body has the pour spout opening located at a position close to the first end. Whereby, for example, it is possible to employ a configuration, in which the elastic member is elastically deformed into a curved shape when the lid member has been attached to the cap body, and restored into a straight shape when the lid member has been detached from the cap body.

In the cap of the present invention, the pour spout opening may be disposed at a position close to a first end of the cap body, and the coupling member is connected to the cap body at a position closer to the first end of the cap body than the elastic member is.

According to the cap having the above configuration, the coupling member is connected to the cap body at a position closer to the first end of the cap body than the elastic member is, in which the cap body has the pour spout opening located at a position close to the first end. Whereby, for example, it is possible to employ a configuration, in which the elastic member is elastically deformed into a straight shape when the lid member has been attached to the cap body, and restored into a curved shape when the lid member has been detached from the cap body.

In the cap of the present invention, it is possible to employ a configuration, in which the cap body includes: an engaging stopper member that engages with the coupling member in order to stop the coupling member from being pivotally moved by the first hinge mechanism beyond a predetermined angle, when the lid member is moved close to the cap body; and the engaging stopper member includes a support part that supports the second hinge mechanism with the coupling member held in engagement with the engaging stopper member.

According to the cap having the above configuration, when the lid member is moved close to the cap body, the engaging stopper member engages with the coupling member so as to stop the coupling member from being pivotally moved by the first hinge mechanism beyond a predetermined angle. With the coupling member held in engagement with the engaging stopper member, the support part supports the second hinge mechanism. Thus, the lid member can be easily pivotally moved by the second hinge mechanism.

According to another aspect of the present invention, there is provided a container with a cap including a container that contains content and a cap that is fixed to the container, wherein:

the cap includes a cap body that has a pour spout opening, through which the content of the container is poured out, a lid member that is attached to and detached from the cap body in order to open and close the pour spout opening, an elastic member that couples the lid member to the cap body, and a coupling member that couples the lid member to the cap body;

the elastic member, which has been elastically deformed, is restored during at least part of the movement of the lid member away from the cap body, thereby enabling the lid member to be held away from the cap body; and the coupling member is connected to the cap body via a first hinge mechanism and connected to the lid member via a second hinge mechanism that has an axis parallel to an axis of the first hinge mechanism According to the container with the cap of the present invention, the coupling member, which couples the lid member to the cap body, is connected to the cap body via the first hinge mechanism. Thus, when the coupling member is pivotally moved by the first hinge mechanism, the coupling member and the lid member are integrally moved toward and away from the cap body. Also, the coupling member is connected to the lid member via the second hinge mechanism that has an axis parallel to the axis of the first hinge mechanism. Thus, when the lid member is pivotally moved by the second hinge mechanism, the lid member is moved toward and away from the cap body. Accordingly, for example, it is possible to employ a configuration, in which the coupling member is held at a position close to the cap body when the lid member has been attached to the cap body.

Advantage of the Invention

As described above, according to the cap and the container with the cap, it is possible to produce an excellent effect, such as an effect of enabling flexible designing of the cap and the container with the cap to enable prevention or suppression of increase in volume of the cap when the lid member has been attached to the cap body, while at the same time providing a capability to increase the distance between the lid member and the cap body when the elastic member has been restored.

PREFERRED EMBODIMENTS FOR CARRYING OUT THE INVENTION

Now, the description will be made for a first embodiment of a cap and a container with the cap according to the present invention with reference to FIGS. 1-7.

Figure 1C:
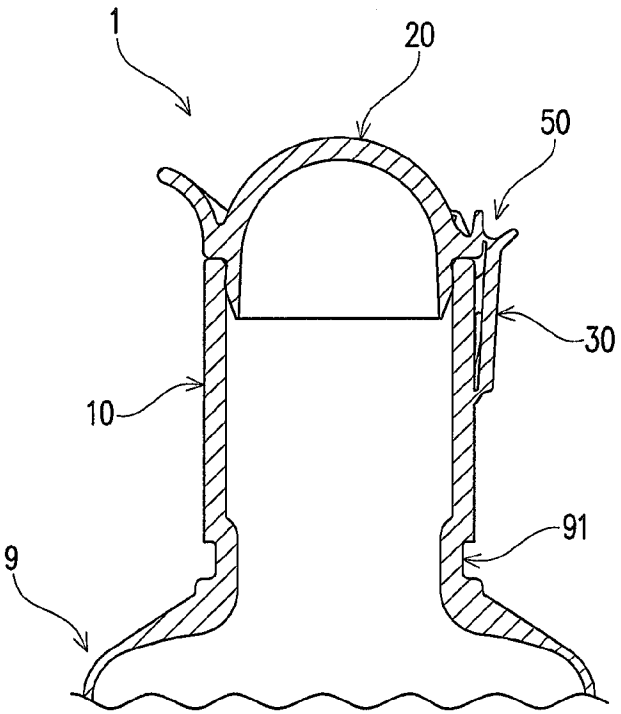
FIG. 1 show a container with a cap according to one embodiment of the present invention, in which a lid member is held in closed position, and specifically, FIG. 1(*a*) is an overall front view of the container, FIG. 1(*b*) is an overall right side view of the container and FIG. 1(*c*) is a cross sectional view of an essential portion taken along a line of A-A.
Figure 1B:
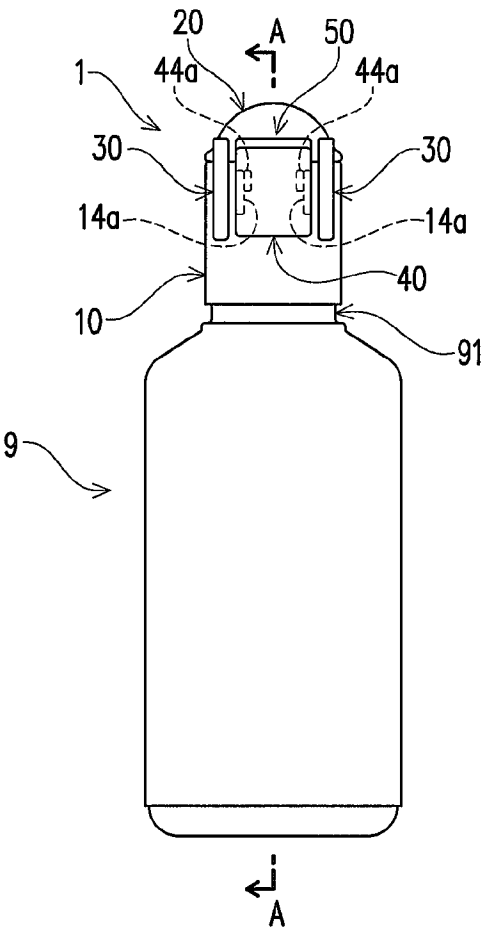
Figure 1A:
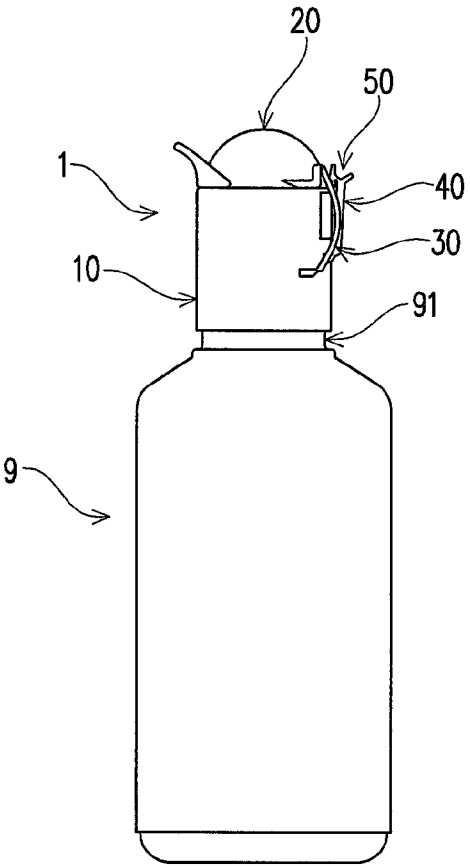

The container with the cap of this embodiment includes, as shown in FIG. 1, a container 9 that contains content (solid or liquid matter), and a cap 1 that is fixed to an opening portion 91 located at an end of the container 9. In this embodiment, the container 9 and the cap 1 are integrally formed of resin or plastic, and thus are configured so that the cap 1 cannot be separated from the container 9.

Figure 2A:
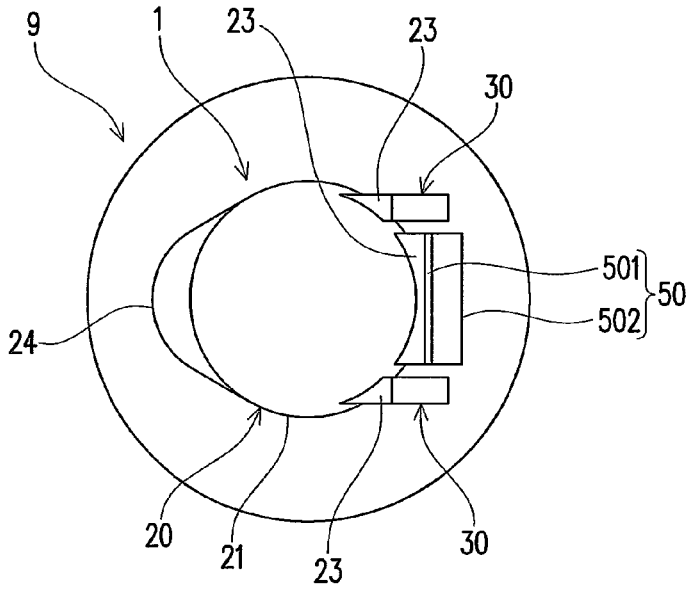
FIG. 2 are overall views of the container with the cap according to the one embodiment, and specifically, FIG. 2(*a*) is a plan view with the lid member held in closed position, and FIG. 2(*b*) is a plan view with the lid member held in open position.
Figure 2B:
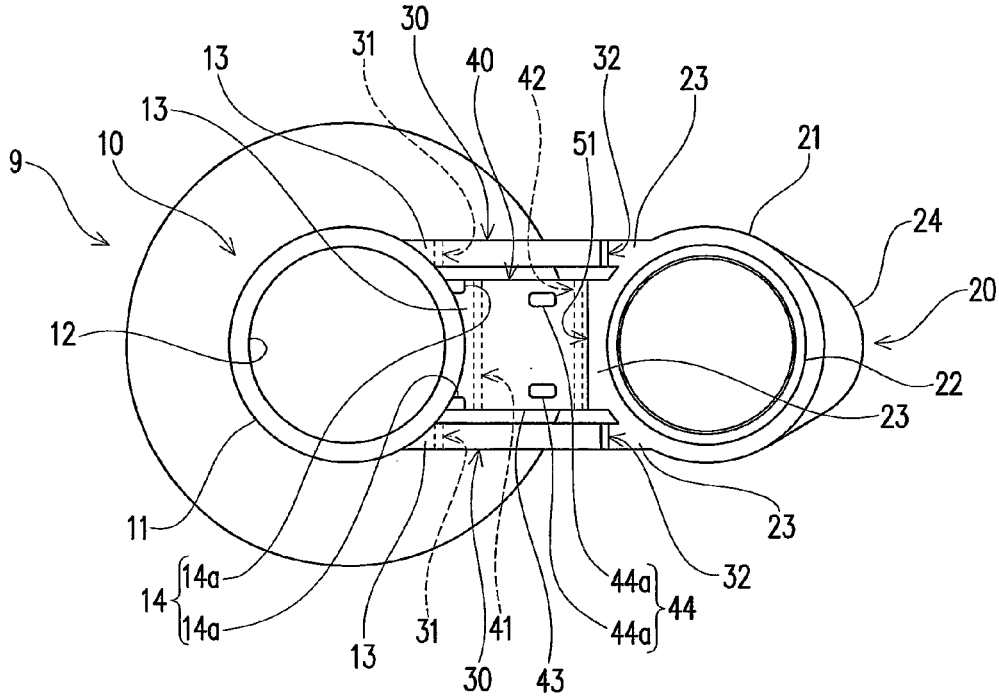
Figure 3A:
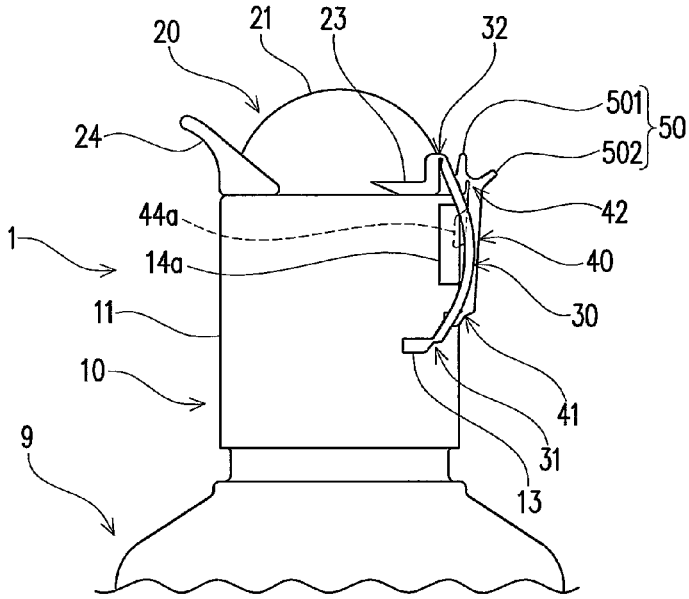
FIG. 3 are views of an essential portion of the container with the cap according to the one embodiment, and specifically, FIG. 3(*a*) is a front view with the lid member held in closed position, and FIG. 3(*b*) is a plan view with the lid member held in open position.
Figure 3B:
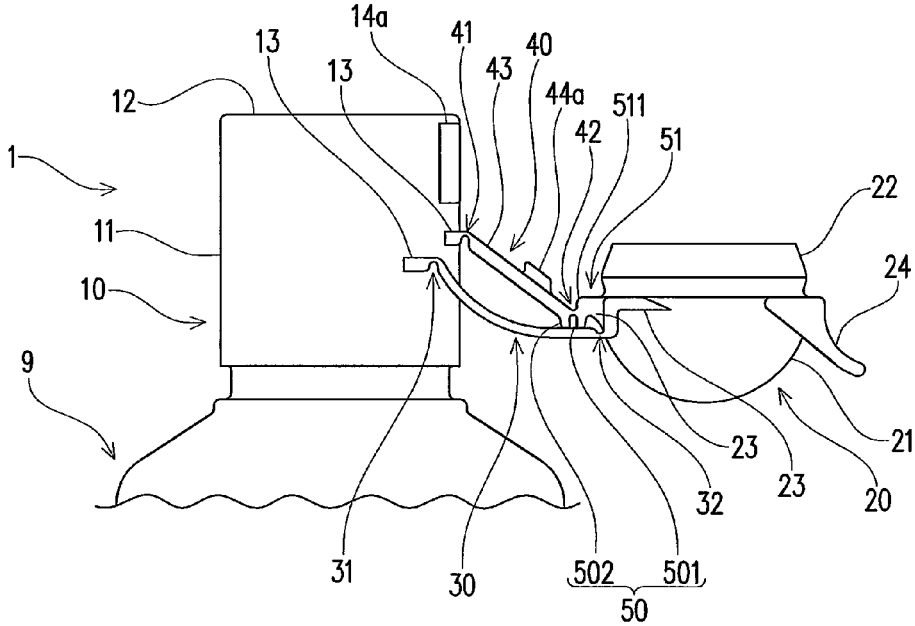
Figure 4B:
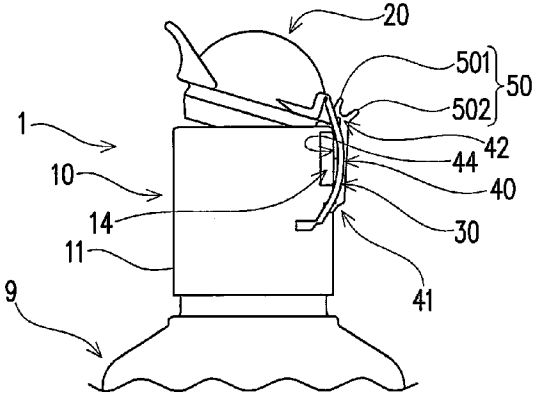
FIG. 4 are views of an essential portion of the container with the cap according to the one embodiment, in which a function is explained, and specifically, FIGS. 4(*a*) to 4(*d*) are front views thereof.
Figure 4D:
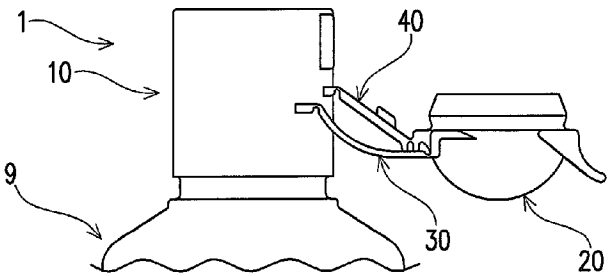
Figure 4A:
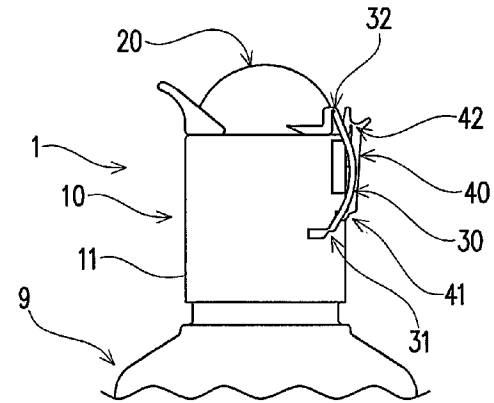
Figure 4C:
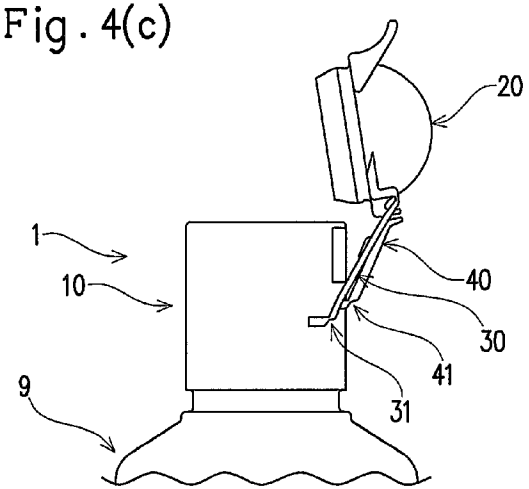

As shown in FIGS. 1-3, the cap 1 includes a cap body 10 that is coupled to the opening portion 91 of the container 9, a lid member 20 that is attached to and detached from the cap body 10, and a pair of elastic members 30, 30 that couple the lid member 20 to the cap body 10. The cap 1 further includes a coupling member 40 that couples the lid member 20 to the cap body 10.

The coupling member 40 is connected to the cap body 10 via a first hinge mechanism 41 and connected to the lid member 20 via a second hinge mechanism 42 that has an axis parallel to the axis of the first hinge mechanism 41. The cap 1 includes first and second pivotal movement restraining devices 50, 51 that restrain the lid member 20 from being moved close to the coupling member 40 beyond a predetermined limit through pivotal movement by the second hind mechanism 42.

The cap body 10 includes a circumferential wall portion 11 that has a cylindrical shape, a pour spout opening 12 that is located at a position close to a first end of the circumferential wall portion 11 in its axial direction to pour out the content of the container 9, and connection pieces 13, 13, 13, through which the elastic members 30, 30 and the coupling member 40 are connected to each other. The cap body 10 is coupled at a position close to a second end of the circumferential wall portion 11 to the opening portion 91 of the container 9.

The cap body 10 includes an engaging stopper member 14 that engages with the coupling member 40 when the lid member 20 is moved away from the cap body 10. The engaging stopper member 14 includes a pair of engaging pieces 14*a*, 14*a* that project radially outwardly from the outer circumference of the circumferential wall portion 11. The pair of engaging pieces 14*a*, 14*a* each have a plate shape extending along the axial direction of the circumferential wall portion 11 and are located to face each other.

The lid member 20 includes a lid body 21 that has a tubular shape (hemispherical shape) with a first end closed, and is configured so that the pour spout opening 12 is opened and closed by the lid body 21 through attaching and detaching action of the lid member 20 with respect to the cap body 10. The lid member 20 includes a sealing part 22 that abuts the pour spout opening 12 to seal the same.

The lid member 20 includes connection pieces 23, 23, 23 that project radially outwardly from the lid body 21 and connect with the elastic members 30, and the coupling member 40, respectively. The lid member 20 includes a flange portion 24 that is operated (hooked) by, for example, a finger when it is detached from the cap body 10.

The sealing part 22 has a cylindrical shape protruding from the second end of the lid body 21. The sealing part 22 is fitted onto the pour spout opening 12 in order to allow the lid member 20 to be fixed to the cap body 10 with the lid body 21 closing the pour spout opening 12. Whereby, the sealing part 22 is tightly fitted to the pour spout opening 12 to thereby seal the pour spout opening 12 when the lid member 20 has been attached to the cap body 10.

Each elastic member 30 has a band and plate shape. Each elastic member 30 has a width smaller than the width of the coupling member 40, and a length greater than the length of the coupling member 40. The pair of elastic members 30, 30 are disposed with the coupling member 40 held therebetween and disposed to have the lengthwise directions thereof oriented parallel to each other.

Each elastic member 30 is connected to the cap body 10 via a third hinge mechanism 31 that has an axis parallel to the axes of the first and second hinge mechanisms 41, 42, and connected to the lid member 20 via a fourth hinge mechanism 32 that has an axis parallel to the axes of the first to third hinge mechanisms 41, 42, 31. Whereby, it is possible to prevent or reduce elastic deformation of each elastic member 30 when the lid member 20 has been attached to the cap body 10.

In this embodiment, each elastic member 30 has such a shape (length) as not to be elastically deformed when the lid member 20 has been attached to the cap body 10. The third and fourth hinge mechanisms 31, 32 each are formed by reducing the thickness of the respective end portions of the elastic members 30. The axes of the pair of the third hinge mechanisms 31, 31 are located in alignment with each other relative to the direction orthogonal to the axes, while the axes of the pair of the fourth hinge mechanisms 32, 32 are located in alignment with each other relative to the direction orthogonal to the axes.

The coupling member 40 includes a coupling body 43 that has a straight belt shape, and an engaged member 44 that is engaged with the engaging stopper member 14. The coupling member 40 is rigid and thus keeps its straight shape or is not deformed when the lid member 20 is moved toward and away from the cap body 10. The first and second hinge mechanisms 41, 42 are formed by reducing the thickness of the respective end portions of the coupling member 40.

The engaged member 44 includes a pair of engaged pieces 44*a*, 44*a* that have a plate shape projecting from the coupling body 43. The pair of the engaged pieces 44*a*, 44*a* are located facing each other, onto which the pair of the engaging pieces 14*a*, 14*a* are fitted when the lid member 20 has been attached to the cap body 10.

Meanwhile, the elastic members 30, 30 and the coupling member 40 are disposed to have their end portions, which are connected to the cap body 10, located away from each other in the direction orthogonal to the axial direction of the hinge mechanisms 31, 41. Specifically, each elastic member 30 is connected to the cap body 10 at a portion of the cap body 10 closer to the second end (lower end) in the axial direction of the cap body 10 (circumferential wall portion 11) than the coupling member 40 is, and closer to the axis of the cap body 10 in the radial direction of the cap body 10 (circumferential wall portion 11) than the coupling member 40 is.

In other words, the axis of each third hinge mechanism is located at a position away from the pour spout opening 12 in the axial direction of the circumferential wall portion 11 than the axis of the first hinge mechanism 41 is, and located closer to the axis of the circumferential wall portion 11 in the radial direction of the circumferential wall portion 11 than the axis of the first hinge mechanism 41 is. With this arrangement, each elastic member 30 is elastically deformed as the lid member 20 is detached and moved away from the cap body 10, and then restored by elastic force when it has been elastically deformed beyond a predetermined limit, thereby enabling the lid member 20 to be held away from the cap body 10.

The elastic members 30, 30 and the coupling member 40 are disposed to have their ends, which are connected to the lid member 20, located away from each other in the direction orthogonal to the axial direction of the hinge mechanisms 32, 42. Specifically, each elastic member 30 is connected to the lid member 20 at a position closer to the first end of the lid member 20 in the axial direction of the lid member 20 (lid body 21) than the coupling member 40 is, and closer to the axis of the lid member 20 in the radial direction of the lid member 20 (lid body 21) than the coupling member 40 is.

In other words, when the lid member 20 has been attached to the cap body 10, the axis of each fourth hinge mechanism 32 is located at a position away from the cap body 10 in the axial direction of the lid body 21 than the axis of the second hinge mechanism 42 is, and closer to the axis of the lid body 21 in the radial direction of the lid body 21 than the axis of the second hinge mechanism 42 is. With this arrangement, each elastic member 30 is elastically deformed to elongate as the lid member 20 is detached and moved away from the cap body 10, and then each elastic member 30 is elastically deformed into a straight shape. Then, the elastic force effected by this deformation causes restoration of each elastic member 30 into a curved shape.

The first pivotal movement restraining device 50 includes a pair of projections 501, 502 that are located adjacent to each other with the second hinge mechanism 42 therebetween, and project outwardly from the lid member 20 and the coupling member 40, respectively. The projection 501 has a plate shape projecting from an end portion of the connection piece 23 of the lid member 20, and the projection 502 has a plate shape projecting from an end portion of the coupling body 43 of the coupling member 40. The second pivotal movement restraining device 51 includes a projection 511 that projects inwardly from the lid member 20. The projection 511 projects convexly from an end portion of the connection piece 23 of the lid member 20.

Now, the description will be made for the function of the cap 1 and the container with the cap according to this embodiment, of which structure is as described above, with reference to FIG. 4.

As shown in FIG. 4(*a*), with the lid member 20 attached to the cap body 10, each elastic member 30 is kept in a curved shape. At this moment, each elastic member 30 is not being elastically deformed due to the existence of the third and fourth hinge mechanisms 31, 32. The coupling member 40 is located along the circumferential wall portion 11 due to the existence of the first and second hinge mechanisms 41, 42.

As shown in FIG. 4(*b*), when the lid member 20 has been detached from the cap body 10, the elastic members 30 is elastically deformed to elongate. At this moment, the engaged member 44 is engaged with the engaging stopper member 14 so that, while the lid member 20 is pivotally moved by the second hinge mechanism 42, the coupling member 40 is not pivotally moved by the first hinge mechanism 41 but remains located along the circumferential wall portion 11.

Furthermore, when the lid member 20 has been moved away from the cap body 10, the pair of the projections 501, 502 of the first pivotal movement restraining device 50 abut each other, thereby restraining the lid member 20 from contacting the coupling member 40 at its outer side through pivotal movement by the second hinge mechanism 42. When the lid member 20 has been further moved from this state to be moved away from the cap body 10 against the force of the engaging stopper members 14 engaging with the engaged member 44, the engaged member 44 can be released from the engagement with the engaging stopper member 14.

Then, as shown in FIG. 4(*c*), the coupling member 40 is pivotally moved by the first hinge mechanism 41 and along with this, each elastic member 30 is elastically deformed into a further elongated shape. When each elastic member 30 has been elastically deformed into a straight shape, each elastic member 30 is restored by the elastic force. Whereby, each elastic member 30 urges the lid member 20 so that the lid member 20 is held away from the cap body 10.

At this moment, the lid member 20, the elastic members 30, 30 and the coupling member 40 are integrally moved away from the cap body 10. Specifically, the lid member 20 and the coupling member 40 are pivotally moved by the first hinge mechanism 41, while each elastic member 30 is pivotally moved by the third hinge mechanism 31 as it is restored (deformed). Then, as shown in FIG. 4(*d*), when each elastic member 30 has been restored into a curved shape, the elastic members 30, 30 and the coupling member 40 together hold the lid member 20 at a balanced position at which they are located away from the cap body 10.

Thus, according to the cap 1 and the container with the cap according to this embodiment, the coupling member 40, which couples the lid member 20 to the cap body 10, is connected to the cap body 10 via the first hinge mechanism 41, so that, when the coupling member 40 is pivotally moved by the first hinge mechanism 41, the coupling member 40 and the lid member 20 are integrally moved toward and away from the cap body 10. The coupling member 40 is connected to the lid member 20 via the second hinge mechanism 42, so that, when the lid member 20 is pivotally moved by the second hinge mechanism 42, the lid member 20 is moved toward and away from the cap body 10.

Thus, when the lid member 20 has been attached to the cap body 10, the coupling member 40 is moved toward the cap body 10 and hence located along the circumferential wall portion 11. Whereby, in a state where each elastic member 30 has been restored, the distance between the lid member 20 and the cap body 10 can be increased, while at the same time, it is possible to prevent or reduce the increase in volume of the cap 1, when the lid member 20 has been attached to the cap body 10.

According to the cap 1 and the container with the cap of this embodiment, the end portions of the elastic members 30, 30 and the coupling member 40, which are connected to the cap body 10, are located away from each other in the direction orthogonal to the axial direction of the hinge mechanisms 31, 41. Whereby, as the lid member 20 is detached and moved away from the cap body 10, each elastic member 30 is elastically deformed. When each elastic member 30 is deformed into a straight shape, it is restored into a curved shape by elastic force to urge the lid member 20, thereby enabling the lid member 20 to be held away from the cap body 10.

According to the cap 1 and the container with the cap of this embodiment, the end portions of the elastic members 30, 30 and the coupling member 40, which are connected to the cap body 10, are located away from each other in the direction orthogonal to the axial direction of the hinge mechanisms 31, 41, so that the lid member 20 can be stopped from being pivotally moved by the first hinge mechanism 41 in a state where each elastic member 30 has been restored. Whereby, the lid member 20 can be held at a position at which the elastic members 30, 30 and the coupling member 40 are balanced to each other.

According to the cap 1 and the container with the cap of this embodiment, the one end of each elastic member 30 is connected to the cap body 10 via the third hinge mechanism 31, and the other end of each elastic member 30 is connected to the lid member 20 via the fourth hinge mechanism 32 that has an axis parallel to the axis of the third hinge mechanism 31. Whereby, when the lid member 20 has been attached to the cap body 10, each elastic member 30 is restrained from being elastically deformed. Thus, even if the lid member 20 is attached to the cap body 10 for a long time, it is possible to prevent plastic deformation of the elastic members 30, 30.

According to the cap 1 and the container with the cap of this embodiment, the end portions of the elastic members 30, 30 and the coupling member 40, which are connected to the lid member 20, are located away from each other in the direction orthogonal to the axial direction of the hinge mechanisms 32, 42. Whereby, in a state where the elastic members 30, 30 have been restored, the lid member 20 can be stopped from being pivotally moved by the second hinge mechanism 42. Thus, the lid member 20 can be held at a position at which the elastic members 30, 30 and the coupling member 40 are balanced to each other.

Meanwhile, although the lid member 20 can be held at a position at which the elastic members 30, 30 and the coupling member 40 are balanced to each other, such balanced position exists in plural in a cap where both end portions of each of the elastic members 30, 30 and the both ends of the coupling member 40, that is, the axes of four hinge mechanisms 31, 32, 41, 42 are located away from each other in the direction orthogonal to their extending directions. The description will be made hereinafter with reference to FIG. 5.

Figure 5A:
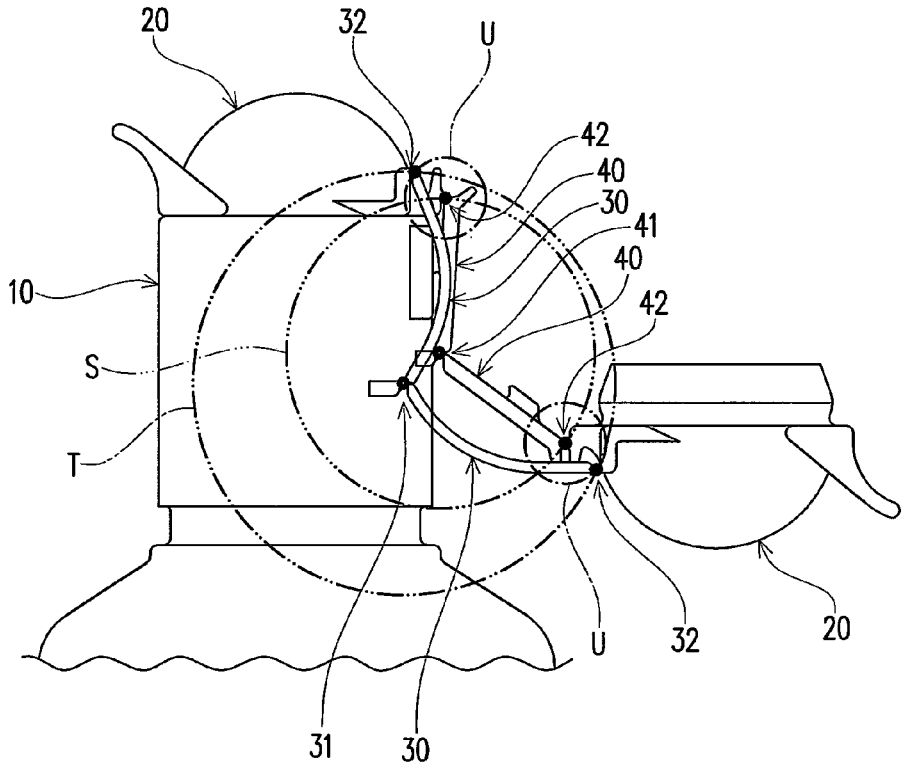
FIG. 5 are views for explaining a function of the container with the cap according to the one embodiment, and specifically, FIG. 5(*a*) is a front view of an essential portion, and FIG. 5(*b*) is a view showing the relationship between axial positions of respective hinge mechanisms.
Figure 5B:
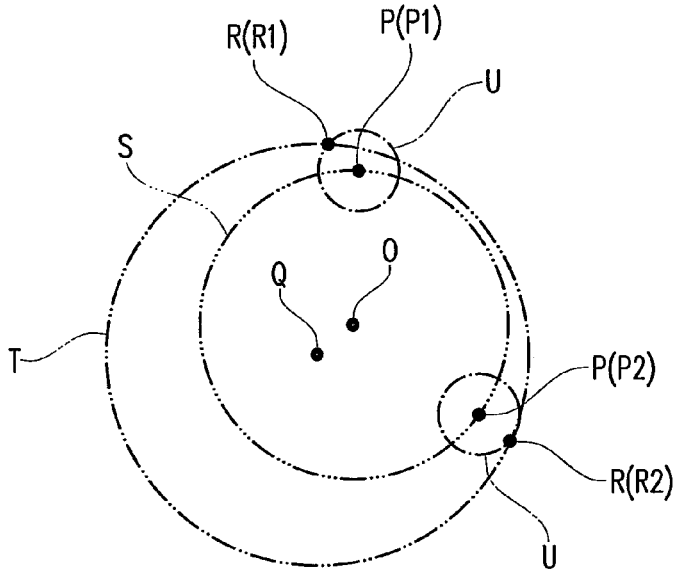

In FIG. 5, a chain triple dashed line S represents a trajectory, through which the axis P of the second hinge mechanism 42 passes when the coupling member 40 has been pivotally moved around the axis O of the first hinge mechanism 41. A chain double dashed line T represents a trajectory, through which the axis R of the fourth hinge mechanism 32 passes when the elastic members 30, 30 have been pivotally moved around the axis Q of the third hinge mechanism 31 without being elastically deformed.

Furthermore, a chain dashed line U represents a trajectory, through which the axis R of the fourth hinge mechanism 32 passes when the lid member 20 is pivotally moved around the axis P of the second hinge mechanism 42. When the coupling member 40 is pivotally moved by the first hinge mechanism 41 and the axis P of the second hinge mechanism 42 is located at a predetermined position, the elastic members 30 and the coupling member 40 are balanced to each other, provided that the axis R of the fourth hinge mechanism 32 is located at a position, at which the chain dashed line U when the axis P of the second hinge mechanism 42 is located at a predetermined position crosses the chain double dashed line T.

Thus, the elastic members 30 and the coupling member 40 are balanced to each other in any of the cases where: the lid member 20 is attached to the cap body 10 (the axial position P1 of the second hinge mechanism 42, the axial position R1 of the fourth hinge mechanism 32); and the lid member 20 is moved away from the cap body 10 and is kept held by the elastic members 30, 30 and the coupling member 40 (the axial position P2 of the second hinge mechanism 42, the axial position R2 of the fourth hinge mechanism 32).

Thus, according to the cap 1 and the container with the cap according to this embodiment, the engaged member 44 of the coupling member 40 is engaged with the engaging stopper member 14 of the cap body 10. Whereby, the lid member 20 is first pivotally moved by the second hinge mechanism 42, and once the pair of projections 501, 502 of the first pivotal movement restraining device 50 abut each other, the coupling member 40 starts to be pivotally moved by the first hinge mechanism 41. Thus, when the coupling member 40 is moved away from the cap body 10 through the pivotal movement by the first hinge mechanism 41, the lid member 20 is located sufficiently away from the coupling member 40 on the inward side (cf., FIG. 4(*c*)).

When each elastic member 30 is restored by elastic force and thus the lid member 20 is moved away from the cap body 10 from the above position, the lid member 20 is held at a position at which the lid member 20 is located away from the cap body 10 (the axial position P2 of the second hinge mechanism 42, the axial position R2 of the fourth hinge mechanism 32) and at which the elastic members 30, 30 and the coupling member 40 are balanced to each other. Thus, it is possible to prevent the lid member 20 from causing obstruction when the content is poured out from the container 9.

Figure 6A:
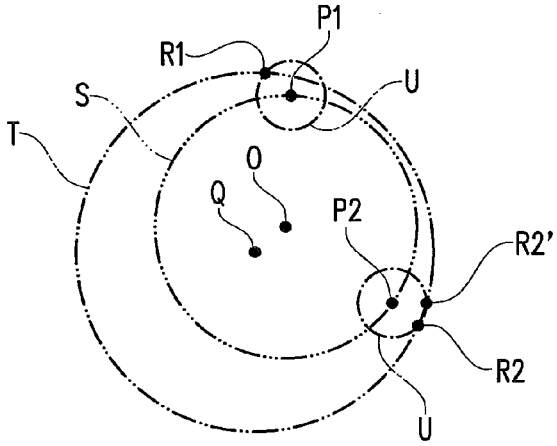
FIG. 6 are views for explaining a function of the container with the cap according to the one embodiment, and specifically, FIG. 6(*a*) is a view showing the relationship between the axial positions of respective hinge mechanisms, and FIGS. 6(*b*) and 6(*c*) are front views of an essential portion.
Figure 6B:
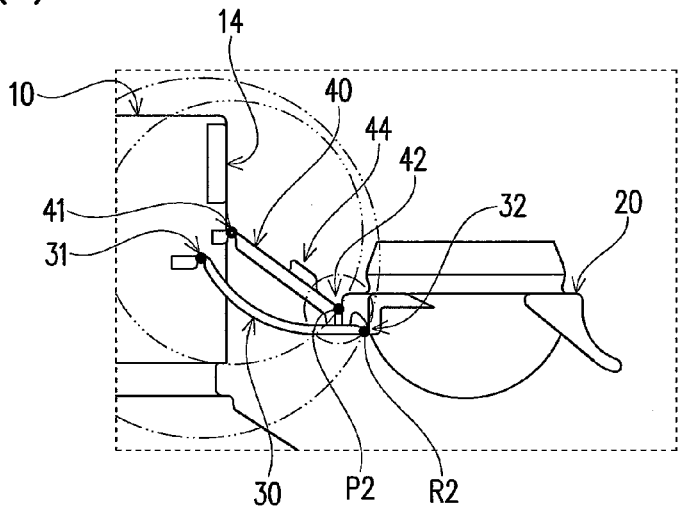
Figure 6C:
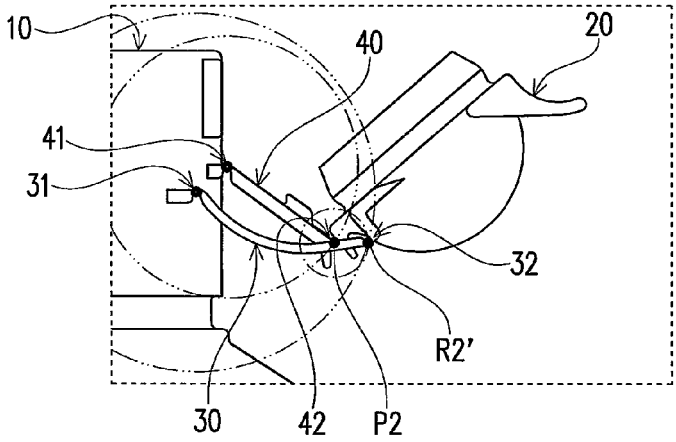

On the contrary, with the arrangement where there are no engaging stopper member 14 and no engaged member 44, the coupling member 40 is pivotally moved away from the cap body 10 by the first hinge mechanism 41 in a state where the lid member 20 is located insufficiently away from the coupling member 40 on the inward side. Thus, as shown in FIG. 6(*c*), the lid member 10 is held at a position at which the lid member 20 is located close to the cap body 10 (the axial position P2 of the second hinge mechanism 42, the axial position R2' of the fourth hinge mechanism 32) and at which the elastic members 30, 30 and the coupling member 40 are balanced to each other. As a result, the lid member 20 causes obstruction when the content is poured out from the container 9.

According to the cap 1 and the container with the cap of this embodiment, even when the lid member 20, which is pivotally moved by the second hinge mechanism 42, is forced to move close to the coupling member 40 beyond a predetermined limit, the first and second pivotal movement restraining devices 50, 51 restrain the pivotal movement. Whereby, even when there are plural positions, at which the elastic members 30, 30 and the coupling member 40 are balanced to each other, the lid member 20 can be held at a predetermined position.

Figure 7A:
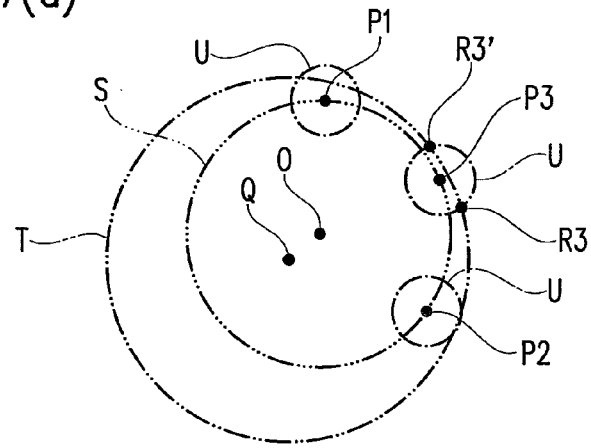
FIG. 7 are views for explaining a function of the container with the cap according to the one embodiment, and specifically, FIG. 7(*a*) is a view showing the relationship between the axial positions of respective hinge mechanisms, and FIGS. 7(*b*) and 7(*c*) are front views of an essential portion.
Figure 7B:
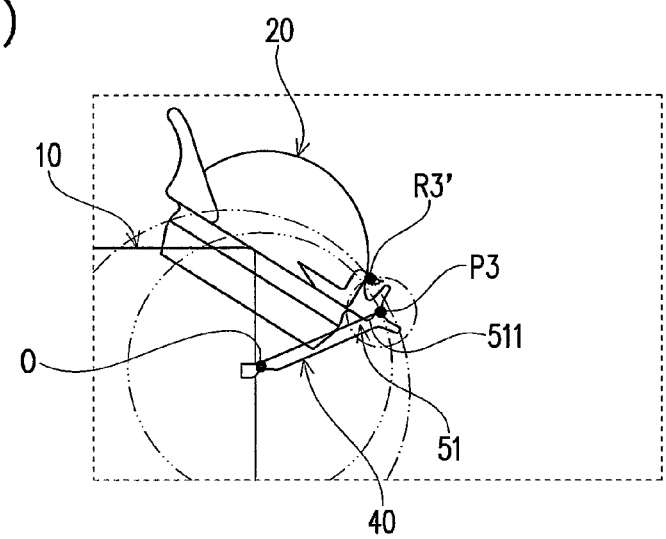
Figure 7C:
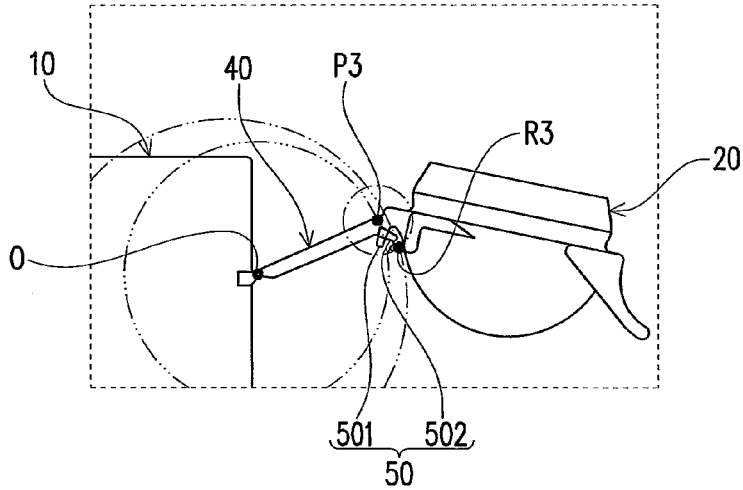
Figure 8A:
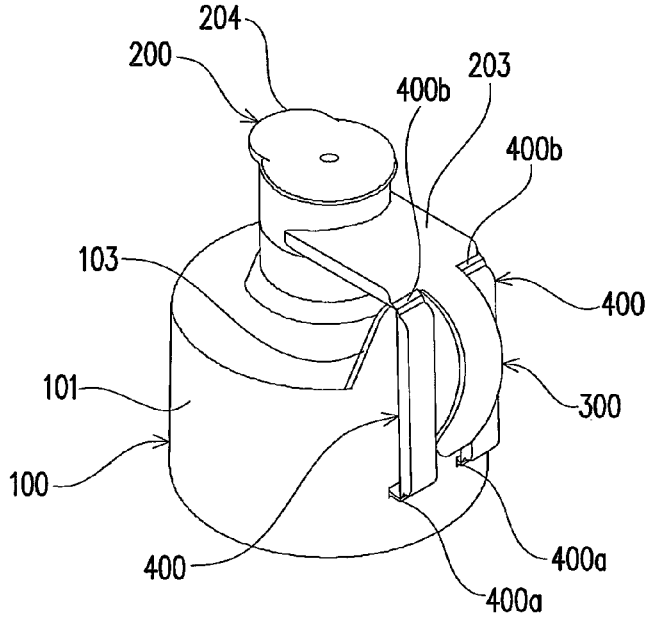
FIG. 8 are overall views of a cap according to another embodiment of the present invention, and specifically, FIG. 8(*a*) is a perspective view with a lid member held in closed position and FIG. 8(*b*) is a perspective view with the lid member held in open position.
Figure 8B:
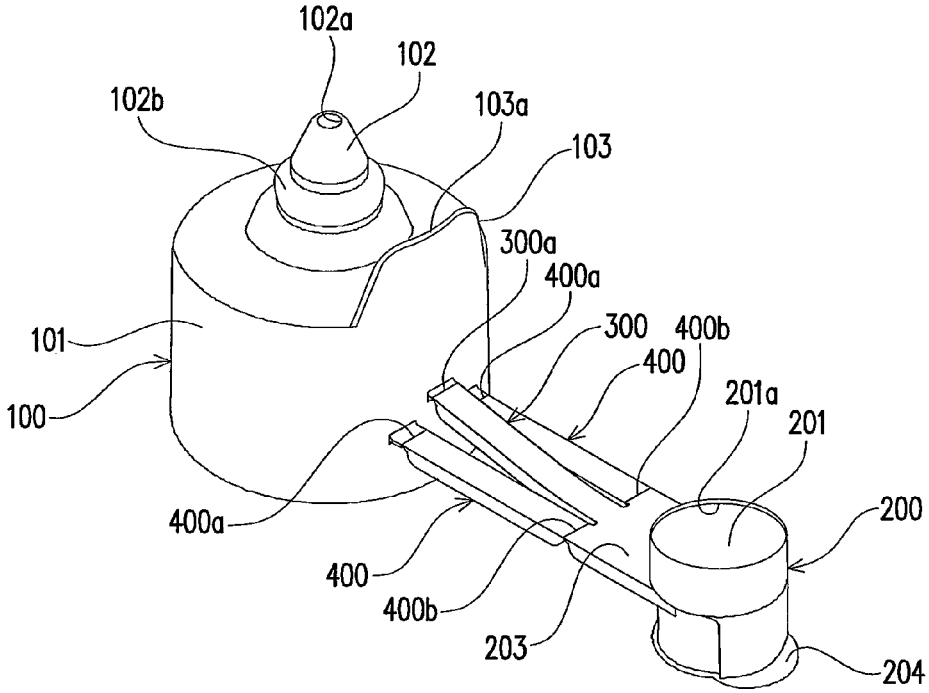
Figure 9A:
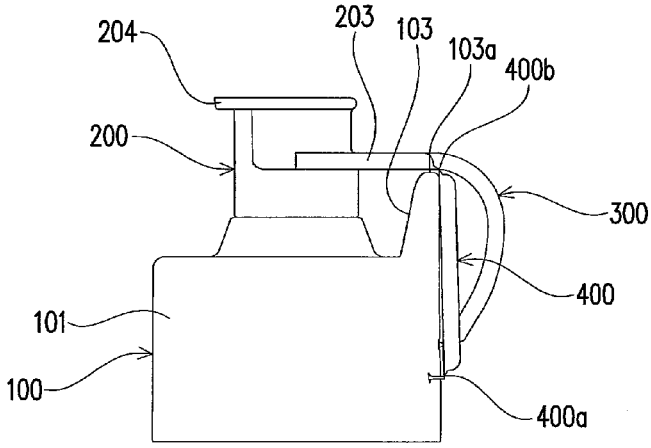
FIG. 9 are overall views of the cap according to this embodiment, and specifically, FIG. 9(*a*) is a front view with the lid member held in closed position and FIG. 9(*b*) is a front view with the lid member held in open position.
Figure 9B:
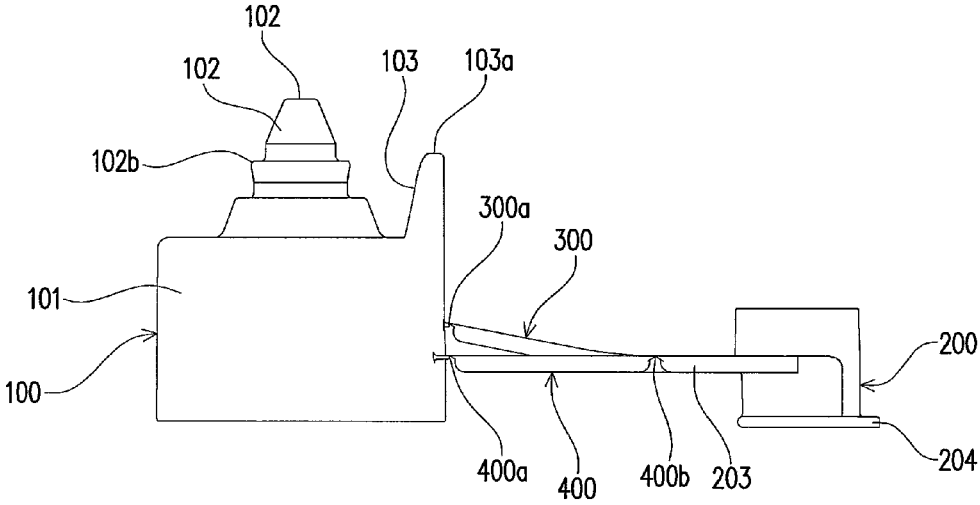
Figure 10A:
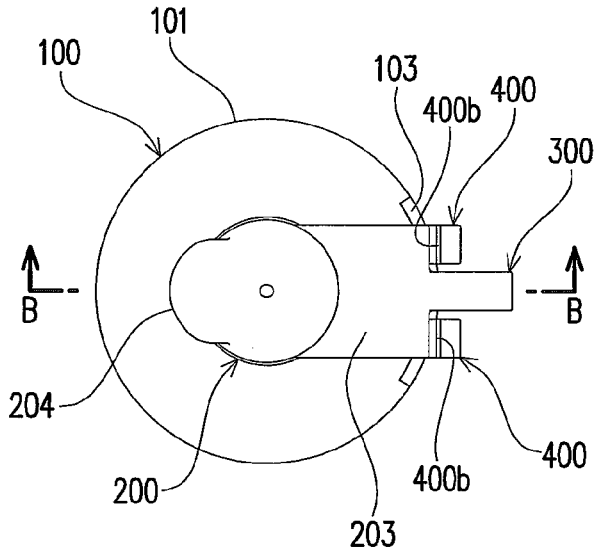
FIG. 10 are overall views of the cap according to this embodiment, and specifically, FIG. 10(*a*) is a plan view with the lid member held in closed position and FIG. 10(*b*) is a plan view with the lid member held in open position.
Figure 10B:
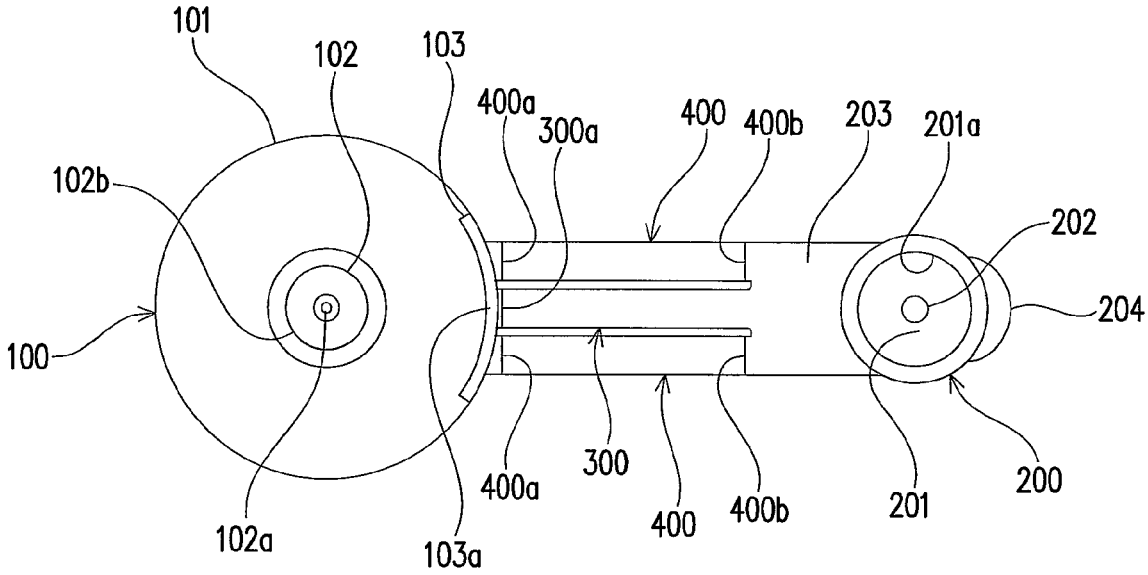
Figure 11:
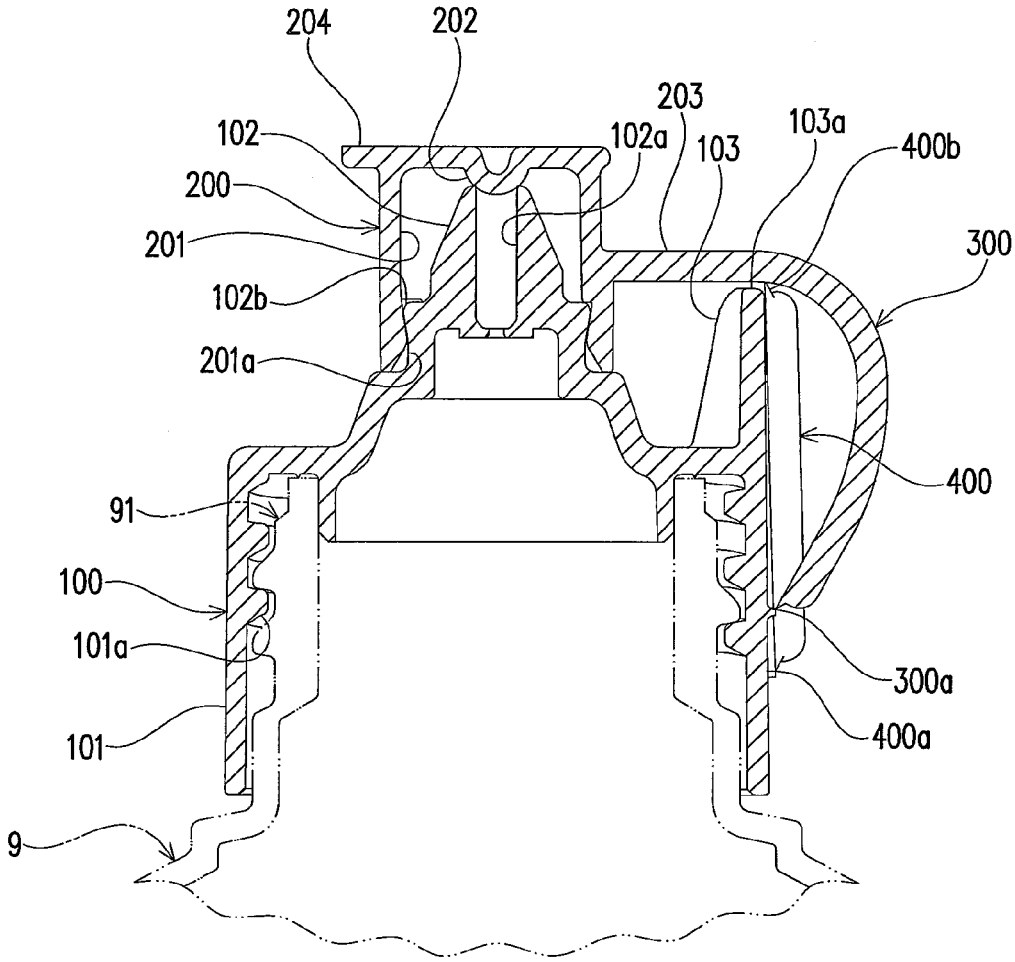
FIG. 11 is an overall view of the cap according to this embodiment, and specifically, a cross sectional view taken along a line B-B in FIG. 10(*a*).
Figure 12A:
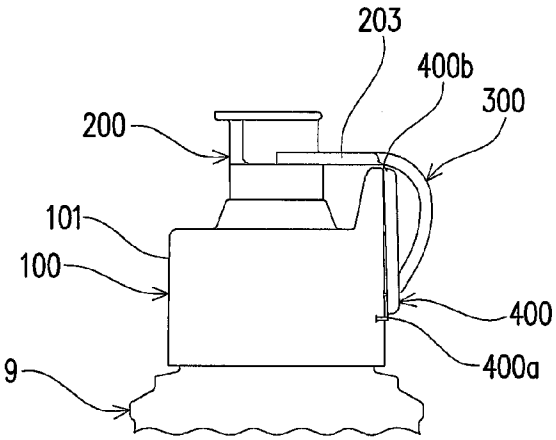
FIG. 12 are overall views for explaining a function of the cap according to this embodiment, and specifically, FIGS. 12(*a*) to 12(*d*) are front views, respectively.
Figure 12B:
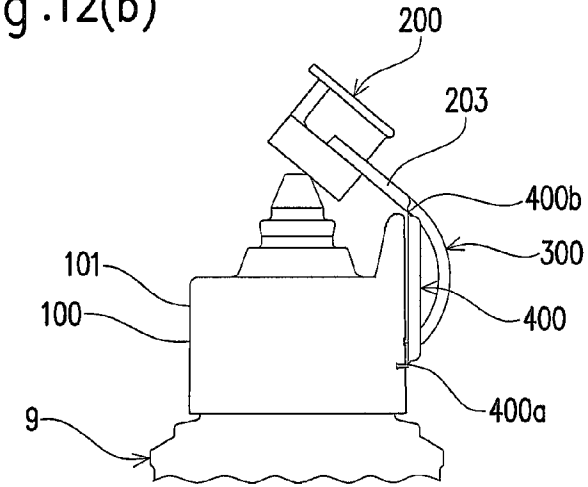
Figure 12C:
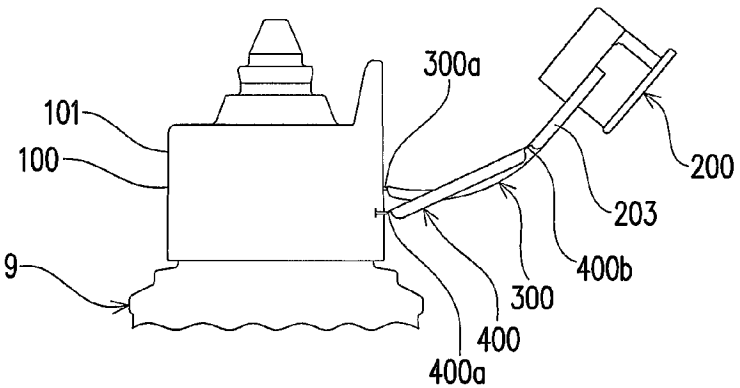
Figure 12D:
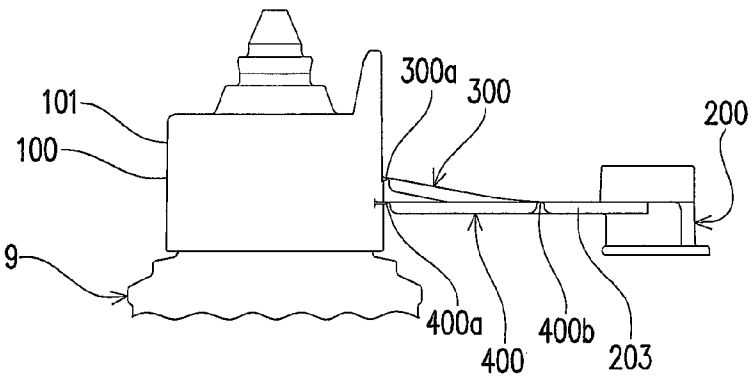

Specifically, as shown in FIG. 7(*a*), when the position of the axis P of the second hinge mechanism 42 is located at a position, such as the axial position P3 located between the axial position P1 (the position at which the lid member 20 is attached to the cap body 10) and the axial position P2 (the position at which the lid member 20 is held at a predetermined position), the projection 511 of the second pivotal movement restraining device 51 abuts the coupling member 40 as shown in FIG. 7(*b*), or the projections 501, 502 of the first pivotal movement restraining device 50 abut each other as shown in FIG. 7(*c*), although the elastic members 30 and the coupling member 40 are to be balanced to each other.

Thus, at the axial position P3, the pivotal movement restraining devices 50, 51 cause the elastic members 30 to be brought into elastically deformed state, so that the elastic members 30 and the coupling member 40 cannot be balanced to each other. Whereby, even when there are plural positions at which the elastic members 30, 30 and the coupling member 40 are balanced to each other, the lid member 20 can be held at a predetermined position.

Now, the description will be made for the second embodiment of the cap and the container with the cap according to the present invention, with reference to FIGS. 8-12.

The cap of this embodiment is made of resin (e.g., plastic). As shown in FIGS. 8-11, the cap includes a cap body 100 that is attached to the opening portion 91 and has a pour spout opening 102*a* for pouring out the content of the container 9, a lid member 200 that is attached to and detached from the cap body 100 to open and close the pour spout opening 102*a*, and an elastic member 300 that couple the lid member 200 to the cap body 100. In addition to the elastic member 300, the cap further includes a pair of coupling members 400, 400 that couple the lid member 200 to the cap body 100.

The cap is configured so that: when the lid member 200 has been attached to the cap body 100, the elastic member 300 is elastically deformed; and when the lid member 200 has been detached from the cap body 100, the elastic member 300 is restored, thereby causing the lid member 200 to be moved away from the cap body 100. The coupling members 400, 400 are connected to the cap body 100, respectively via first hinge mechanisms 400*a* and connected to the lid member 200 via second hinge mechanisms 400*b* that have an axis parallel to the axis of the first hinge mechanisms 400*a*.

The cap body 100 includes a circumferential wall portion 101, to which the elastic member 300 and the coupling members 400, 400 are connected, and a pour spout portion 102 that has the pour spout opening 102*a* located at a position close to a first end of the circumferential wall portion 101. The cap body 100 includes a engaging stopper member 103 that engages with the coupling members 400, 400 when the lid member 200 is moved close to the cap body 100.

The circumferential wall portion 101 has a cylindrical shape and is connected at its circumferential portion to the elastic member 300 and the coupling members 400, 400. The circumferential wall portion 101 has a threaded portion on the inner circumferential portion, through which the circumferential wall portion 101 is threaded into the opening portion 91 of the container 9 to be attached to the opening portion 91 of the container 9.

The pour spout portion 102 extends from the position close to the first end of the circumferential wall portion 101 along the axial direction of the circumferential wall portion 101. The pour spout portion 102 has the pour spout opening 102*a* located at a position close to its tip end (the first end), and has an engaging stopper member 102*b* located at a position close to its base end, which engages with the lid member 200 to fix the lid member 200 in position when the lid member 200 closes the pour spout opening 102*a*. The overall shape of the pour spout portion 102 is conical, which decreases in diameter towards the tip end side, and, on the portion of the engaging stopper member 102*b*, increases in diameter towards the tip end side.

The pour spout portion 102 provides communication between the inside of the circumferential wall portion 101 and the outside of the cap body 100 (circumferential wall portion 101) via the pour spout opening 102*a*. Specifically, the pour spout portion 102 provides communication between the inside and outside of the container 9 when the cap body 100 has been attached to the container 9.

The engaging stopper member 103 projects from the outer peripheral edge of the first end of the circumferential wall portion 101 in the axial direction, and has a curved plate shape standing upright. With this, the engaging stopper member 103 is configured so as to stop the coupling members 400, 400 from being pivotally moved by the first hinge mechanism 400*a* beyond a predetermined angle. The engaging stopper member 103 includes a support part 103*a* at its leading end to support the second hinge mechanism 400*b* and thereby enable the lid member 200 to be easily pivotally moved by the second hinge mechanism 400*b* in a state where the engaging part 103 keeps engaging with the coupling members 400, 400.

The lid member 200 includes a housing 201 having a cylindrical shape to house the pour spout portion 102, and a sealing part 202 that abuts the pour spout opening 102*a* to seal the pour spout opening 102*a*. The lid member 200 includes a connection piece 203, to which the elastic member 300 and the coupling members 400, 400 are connected, and a flange part 204 that is operated (hooked) when the lid member 200 is to be detached from the cap body 100.

The housing 201 allows the pour spout portion 102 to be placed thereinto, or fit over the pour spout portion 102, thereby housing the pour spout portion 102. The housing 201 includes an engaged part 201*a*, with which the engaging stopper member 102*b* of the pour spout portion 102 engages, thereby allowing the lid member 200 (sealing part 202) to be fixed to the cap body 100 (the pour spout portion 102) when the lid member 200 (sealing part 202) is to close the pour spout opening 102*a*. The housing 201 has a diameter smaller than the circumferential wall portion 101 of the cap body 100. The engaged part 201*a* is formed at a distal end of the housing 201 and projects radially inwardly.

The sealing part 202 is formed at a proximal end of the housing 201 and projects inwardly. The sealing part 202 is brought into tight contact with an inner periphery of the pour spout opening 102*a* to seal (close) the pour spout opening 102*a* when the housing 201 has been fixed to the pour spout portion 102.

The connection piece 203 radially projects from the housing 201 and has a plate shape. The connection piece 203 is configured so that, when the housing 201 has been fixed to the pour spout portion 102, the end portion of the connection piece 203, to which the elastic member 300 and the coupling members 400, 400 are connected, is substantially matched in position with the outer peripheral edge of the circumferential wall portion 101 in the axial direction of the circumferential wall portion 101 (housing 201).

The elastic member 300 is connected to the cap body 100 via a third hinge mechanism 300*a* that has an axis parallel to the axes of the hinge mechanisms 400*a*, 400*b*. The elastic member 300 has a band shape and is formed to have a length greater than the coupling members 400, 400. The elastic member 300 and the coupling members 400, 400 are disposed to have their end portions, which are connected to the cap body 100, located away from each other in the direction orthogonal to the axial direction of the hinge mechanisms 300*a*, 400*a*, 400*b*.

Specifically, the elastic member 300 is connected to the cap body 100 (circumferential wall portion 101) at a position closer to a first end (pour spout portion 102) than the coupling members 400, 400 are. With this, the elastic member 300 is elastically deformed into a curved shape when the lid member 200 has been attached to the cap body 100, and is restored into a straight shape when the lid member 200 has been detached from the cap body 100. The third hinge mechanism 300*a* is formed by reducing the thickness of an end portion of the elastic member 300.

Each coupling member 400 has rigidity and has a straight band shape. The pair of the coupling members 400, 400 are aligned to each other with the elastic member 300 therebetween. Each coupling member 400 is located along the circumferential wall portion 101 when the lid member 200 has been attached to the cap body 100. The hinge mechanisms 400*a*, 400*b* are formed by reducing the thickness of the respective end portions of each coupling member 400.

Each coupling member 400 is connected to the cap body 100 via the first hinge mechanism 400*a* to be able to be moved toward and away from the cap body 100 integrally with the lid member 200. Each coupling member 400 is connected to the lid member 200 via the second hinge mechanism 400*b* to enable the lid member 200 to be moved toward and away from the cap body 100. Each coupling member 400 maintains its straight shape, that is, is not deformed when it is pivotally moved via the hinge mechanisms 400*a*, 400*b*.

The cap and the container with the cap according to this embodiment have the configurations as described above, and now the description will be made for the function of the cap and the container with the cap according to this embodiment with reference to FIG. 12.

First, the description will be made for the case where the lid member 200 is detached from the cap body 100. As shown in FIG. 12(*a*), when the lid member 200 is attached to the cap body 100, the elastic member 300 is elastically deformed into a curved shape. Each coupling member 400 is located along the circumferential wall portion 101.

When the lid member 200 has been detached from the cap body 100, the elastic member 300 is restored to allow the connection piece 203 of the lid member 200 and the end portion of the elastic member 300 to be aligned in straight line, as shown in FIG. 12(*b*), since the elastic member 300 is connected to the lid member 200 without the hinge mechanisms. At this moment, the lid member 200 is pivotally moved by the second hinge mechanism 400*b*.

Then, as shown in FIG. 12(*c*), the lid member 200, the elastic member 300 and the coupling members 400, 400 are integrally moved away from the cap body 100 due to the restoration force of the elastic member 300, which causing the elastic member 300 to be restored entirely into a straight shape. At this moment, the lid member 200 and each coupling member 400 are pivotally moved by the first hinge mechanism 400*a*, and the elastic member 300 is pivotally moved by the third hinge mechanism 300*a* while it is being restored or deformed.

As shown in FIG. 12(*d*), when the elastic member 300 is restored into a straight shape, the elastic member 300 and the coupling members 400, 400 together hold the lid member 200 at a balanced position. That is, the elastic member 300 and the coupling members 400, 400 together hold the lid member 200 at a position at which the lid member 200 is located away from the cap body 100.

Now, the description will be made for the case where the lid member 200 is attached to the cap body 100. As shown in FIG. 12(*d*), when the lid member 200 is urged from the position at which the elastic member 300 and the coupling members 400, 400 together hold the lid member 200, the lid member 200, the elastic member 300 and the coupling members 400, 400 are integrally moved toward the cap body 100, as shown in FIG. 12(*c*).

At this moment, the elastic member 300 is pivotally moved by the third hinge mechanism 300*a* while it is elastically deformed, and the lid member 200 and each coupling member 400 is pivotally moved by the first hinge mechanism 400*a*. Accordingly, as shown in FIG. 12(*b*), the engaging part 103 engages with each coupling member 400 so that each coupling member 400 is stopped from being pivotally moved by the first hinge mechanism 400*a*. Along with this, the lid member 200 and the elastic member 300 are also stopped from being pivotally moved by the first hinge mechanism 400*a* and the third hinge mechanism 300*a*, respectively.

Then, when the lid member 200 is further urged, the lid member 200 is pivotally moved by the second hinge mechanism 400*b* while the support part 103*a* of the engaging part 103 supports the second hinge mechanism 400*b*. Accordingly, as shown in FIG. 12(*a*), the elastic member 300 is further elastically deformed into a curved shape so that the lid member 200 is attached to the cap body 100 while each coupling member 400 is located along the circumferential wall portion 101.

Thus, according to the cap and the container with the cap of this embodiment, each coupling member 400 is connected to the cap body 100 via the first hinge mechanism 400*a* so that, when each coupling member 400 is pivotally moved by the first hinge mechanism 400*a*, the lid member 200, the elastic member 300 and each coupling member 400 are integrally moved toward and away from the cap body 100. Also, each coupling member 400 is connected to the lid member 200 via the second hinge mechanism 400*b* so that, when the lid member 200 is pivotally moved by the second hinge mechanism 400*b*, the lid member 200 is moved toward and away from the cap body 100. Whereby, the lid member 200 is moved toward and away from the cap body 100 by being pivotally moved by the two different axes.

Furthermore, it is configured so that, when the lid member 200 has been attached to the cap body 100, each coupling member 400 is held at a position close to the cap body 100. Thus, when the elastic member 300 has been restored, the distance between the lid member 200 and the cap body 100 can be increased, while at the same time, it is possible to prevent or reduce the increase in volume of the cap, when the lid member 200 has been attached to the cap body 100.

According to the cap and the container with the cap of this embodiment, the end portions of the elastic member 300 and the coupling members 400, 400 are located away from each other in the axial direction of the circumferential wall portion 101. Whereby, when the elastic member 300 is in a restored position, the elastic member 300 and the coupling members 400, 400 together stop the lid member 200 from being pivotally moved so as to stably hold the lid member 200 at a balanced position.

According to the cap and the container with the cap of this embodiment, the elastic member 300 is connected to the circumferential wall portion 101 of the cap body 100 at a portion closer to a first end of the circumferential wall portion 101 than the coupling members 400, 400 are. Whereby, the elastic member 300 is elastically deformed into a curved shape when the lid member 200 has been attached to the cap body 100, and restored into a straight shape when the lid member 200 has been detached from the cap body 100.

According to the cap and the container with the cap of this embodiment, when the lid member 200 is moved toward the cap body 100, the engaging part 103 engages with each coupling member 400, so that the engaging part 103 stops each coupling member 400 from being pivotally moved by the first hinge mechanism 400*a* beyond a predetermined angle. Also, when the engaging part 103 is engaging with each coupling member 400, the support part 103*a* provided at the leading end of the engaging part 103 supports the second hinge mechanism 400*b* so that the lid member 200 can be easily pivotally moved by the second hinge mechanism 400*b*.

According to the cap and the container with the cap of this embodiment, the elastic member 300 is connected to the circumferential wall portion 101 of the cap body 100 via the third hinge mechanism 300*a*. Whereby, the end portion of the elastic member 300 is prevented from being locally deformed. Thus, it is possible to prevent plastic deformation of the elastic member 300.

Figure 13A:
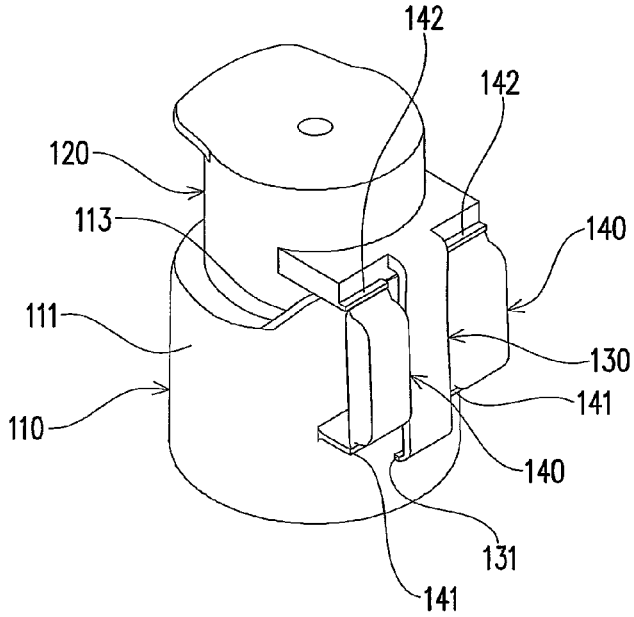
FIG. 13 are overall views of the cap according to still another embodiment of the present invention, and specifically, FIG. 13(*a*) is a perspective view with a lid member held in closed position and FIG. 13(*b*) is a perspective view with the lid member held in open position.
Figure 13B:
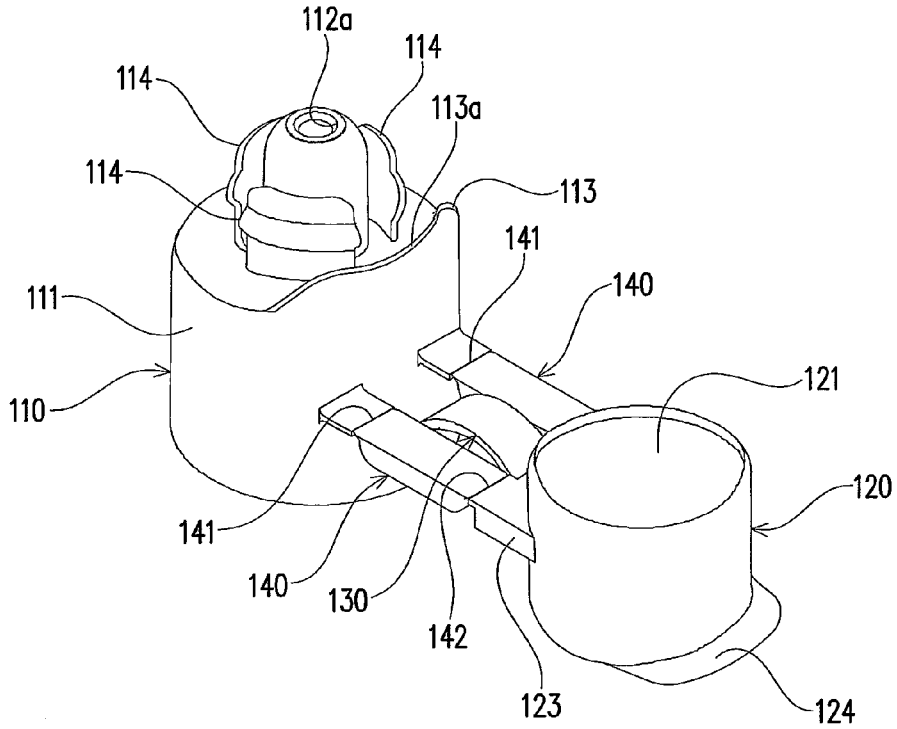
Figure 14B:
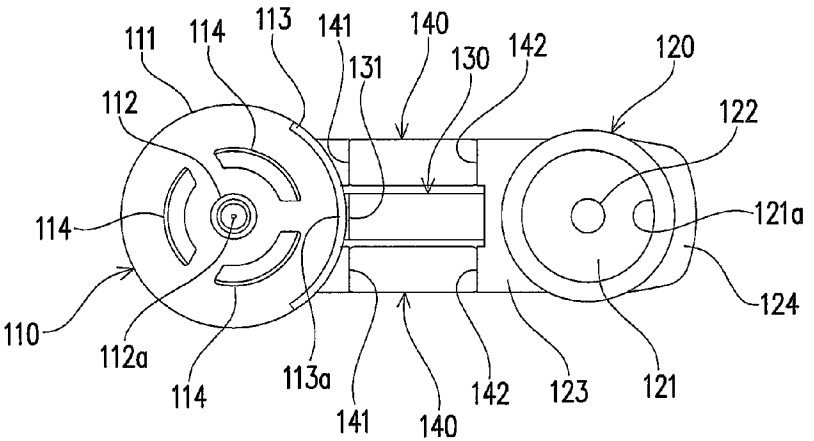
FIG. 14 are overall views of the cap of this embodiment, and specifically, FIG. 14(*a*) is a plan view with the lid member held in closed position, FIG. 14(*b*) is a plan view with the lid member held in open position, FIG. 14(*c*) is a front view with the lid member held in closed position, and FIG. 14(*d*) is a front view with the lid member held in open position.
Figure 14A:
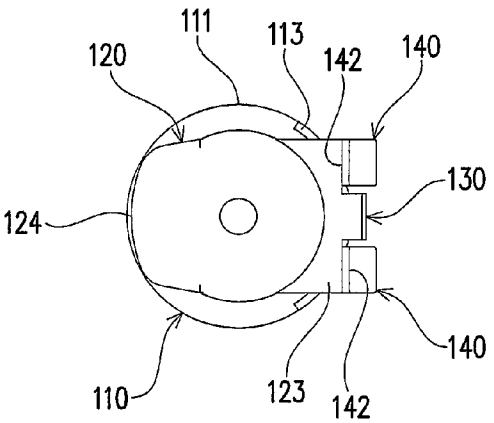
Figure 14D:
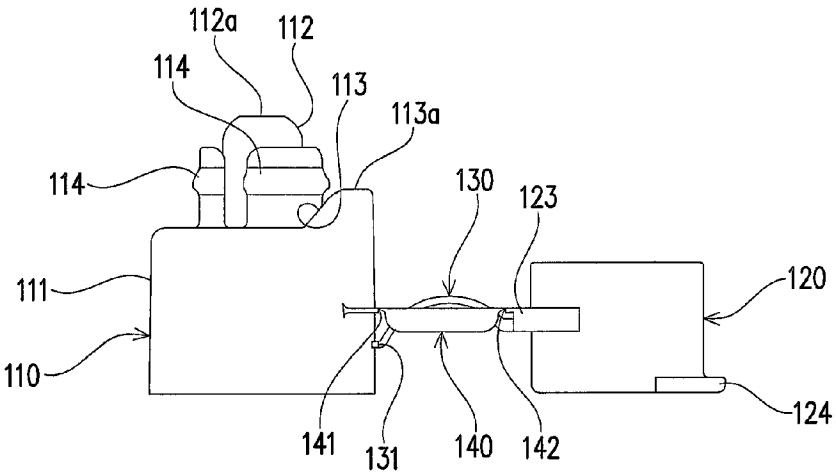
Figure 14C:
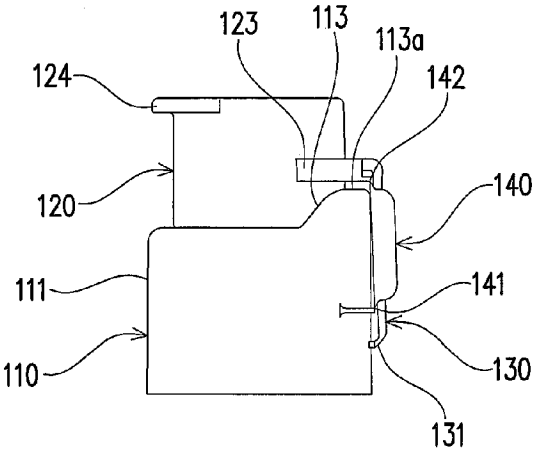
Figure 15A:
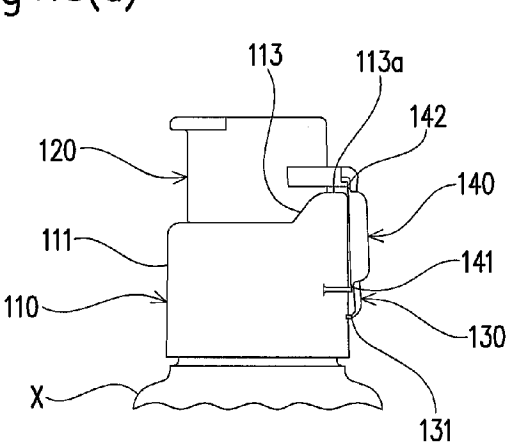
FIG. 15 are overall views for explaining a function of the cap according to this embodiment, and specifically, FIG. 15(*a*) to FIG. 15(*d*) are front views, respectively.
Figure 15B:
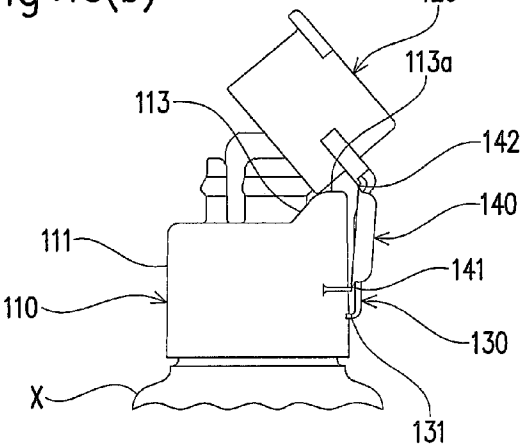
Figure 15C:
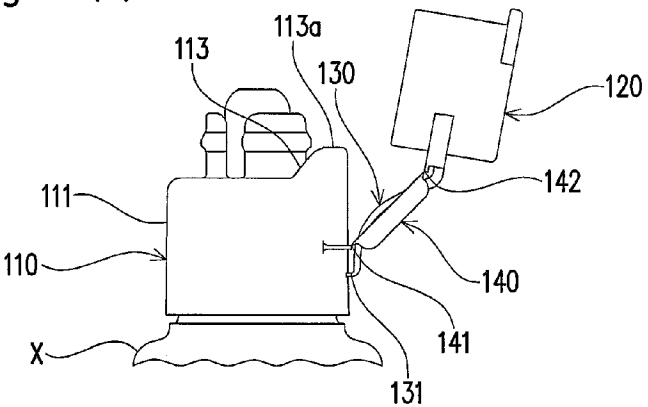
Figure 15D:
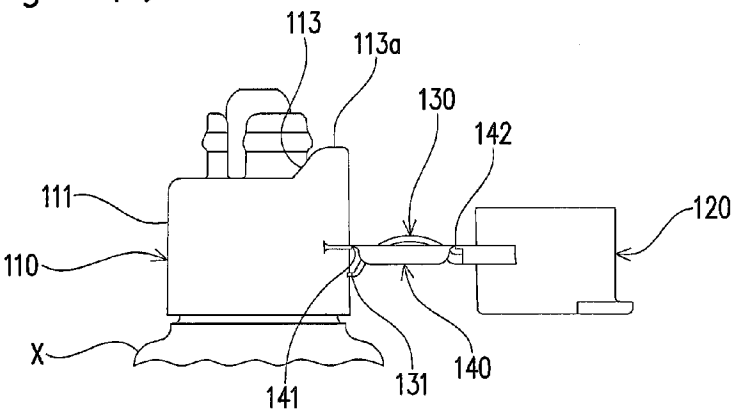
Figure 16C:
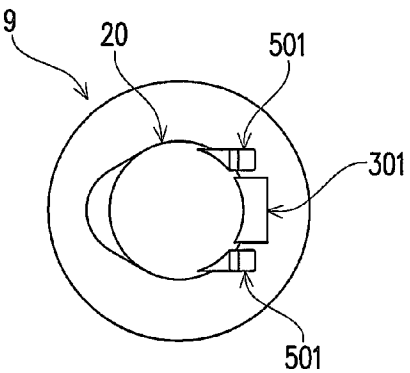
FIG. 16 are overall views of a container with a cap according to yet another embodiment of the present invention, and specifically, FIG. 16(*a*) is a front view with a lid member held in closed position, FIG. 16(*b*) is a right side view with the lid member held in closed position, FIG. 16(*c*) is a plan view with the lid member held in closed position, and FIG. 16(*d*) is a plan view with the lid member held in open position.
Figure 16D:
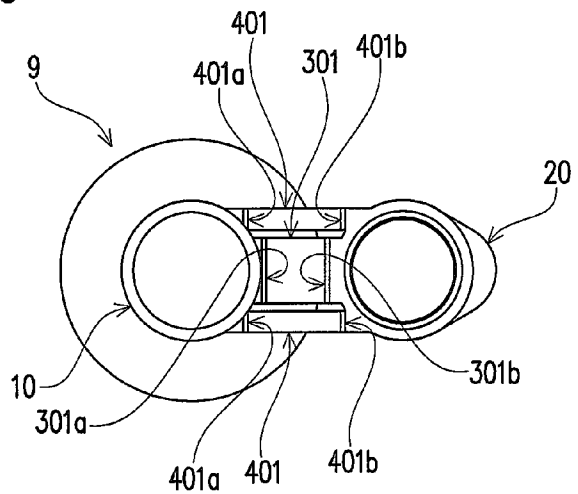
Figure 16B:
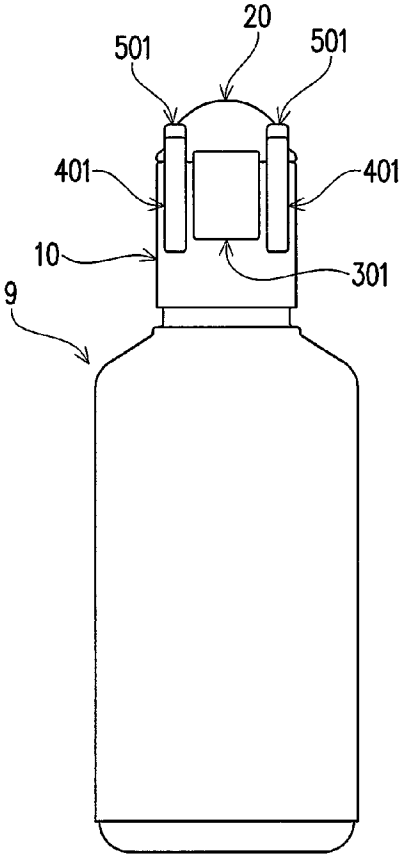
Figure 16A:
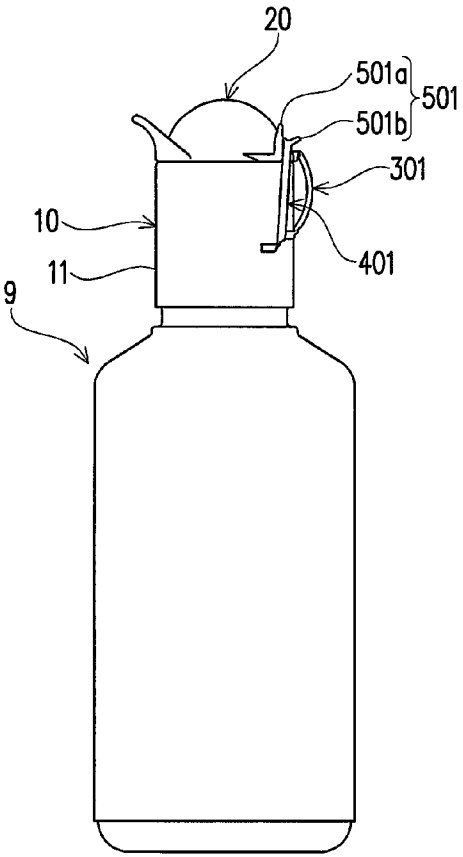
Figure 17B:
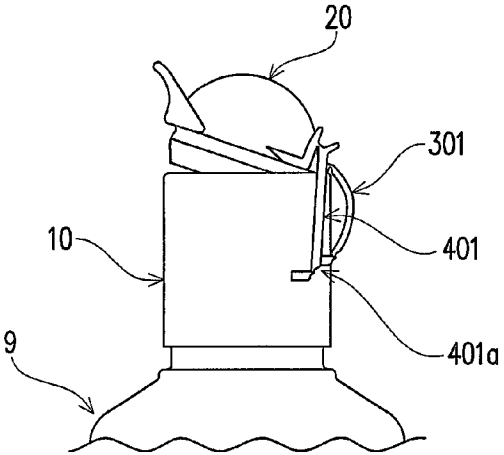
FIG. 17 are views of an essential portion for explaining a function of the container with the cap according to this embodiment, and specifically, FIGS. 17(*a*) to 17(*d*) are front views, respectively.
Figure 17D:
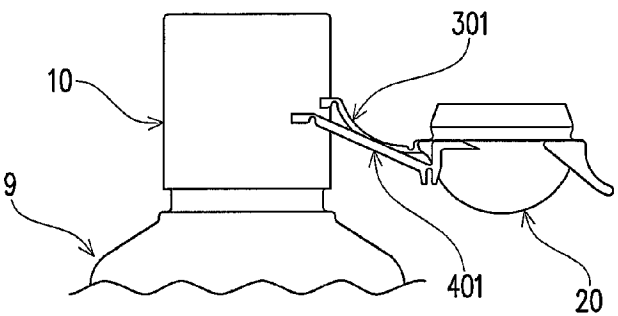
Figure 17A:
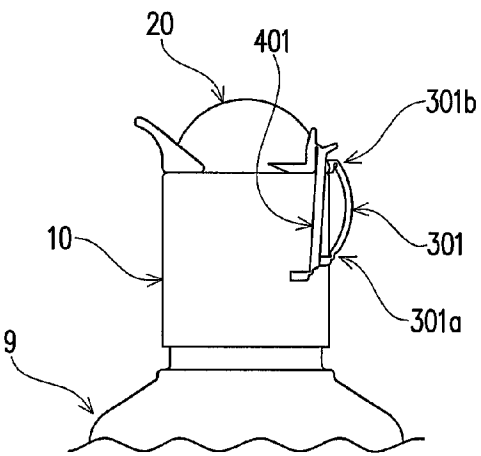
Figure 17C:
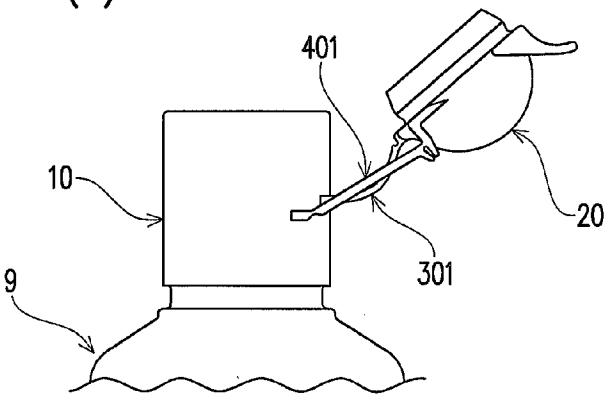
Figure 18B:
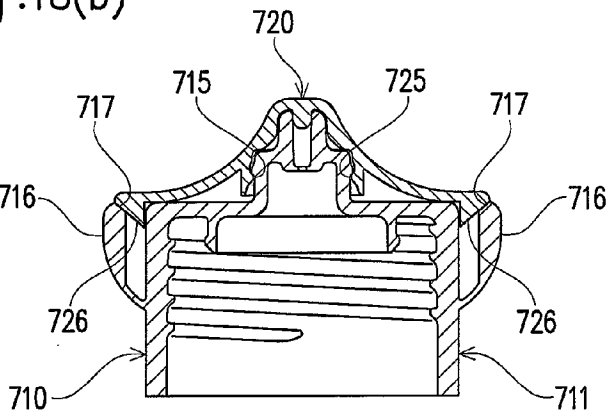
FIG. 18 are overall views for explaining a function of a cap according to another embodiment of the present invention, and specifically, FIG. 18(*a*) is a front view, FIG. 18(*b*) is a cross sectional view taken along a line C-C, FIG. 18(*c*) is a front view, and FIG. 18(*d*) is a cross sectional view taken along a line D-D.
Figure 18D:
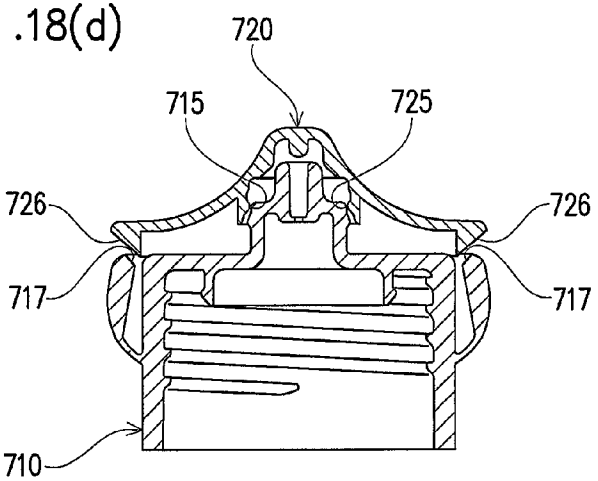
Figure 18A:
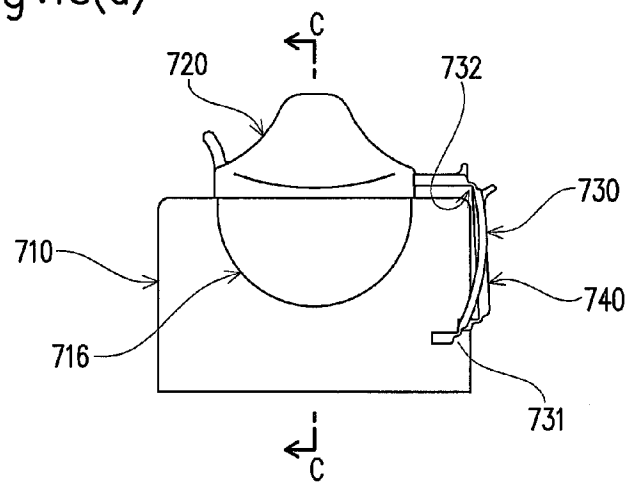
Figure 18C:
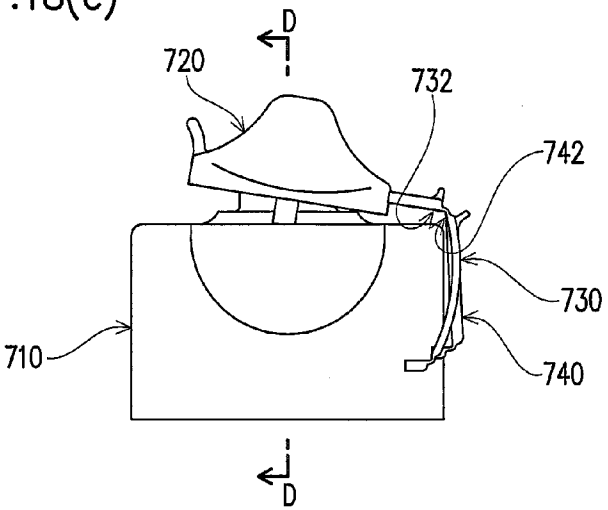
Figure 19A:
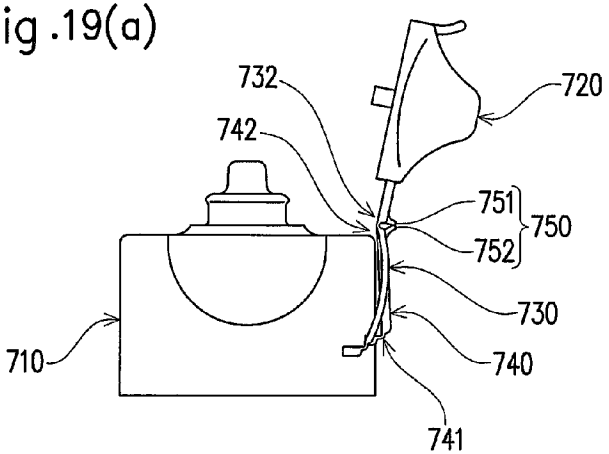
FIG. 19 are overall views for explaining a function of the cap according to this embodiment, and specifically, FIGS. 19(*a*) to 19(*c*) are front views, respectively, and FIG. 19(*d*) is a plan view of the cap held in the position shown in FIG. 19(*c*).
Figure 19B:
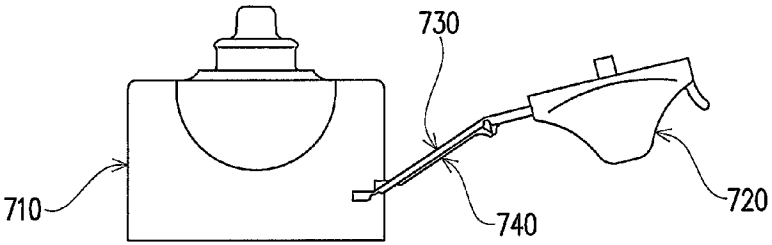
Figure 19C:
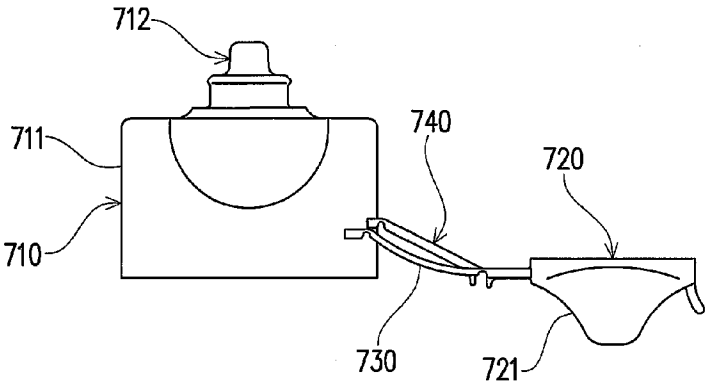
Figure 19D:
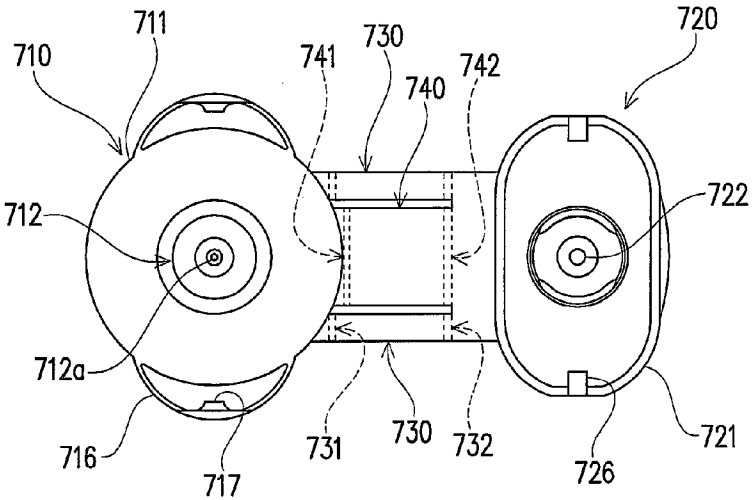
Figure 20A:
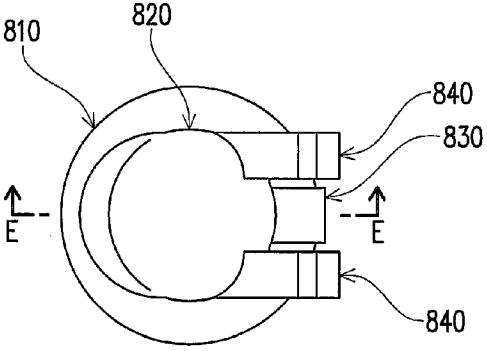
FIG. 20 are overall views of a cap according to still another embodiment of the present invention, and specifically, FIG. 20(*a*) is a plan view with a lid member held in closed position, FIG. 20(*b*) is a plan view with the lid member held in open position, FIG. 20(*c*) is a cross sectional view taken along a line E-E, and FIG. 20(*d*) is a cross sectional view taken along a line F-F.
Figure 20B:
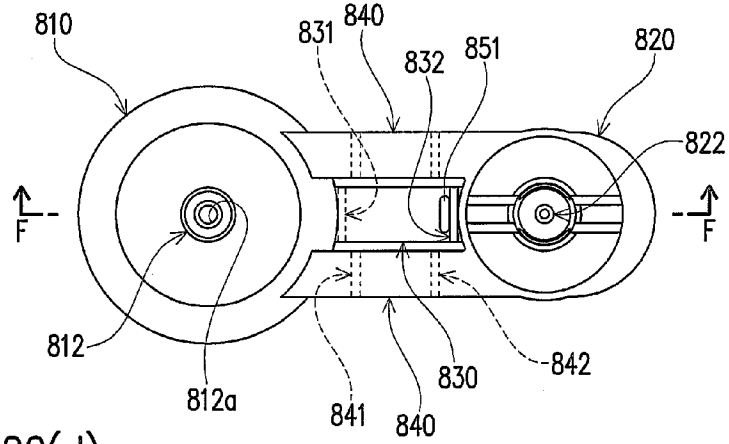
Figure 20C:
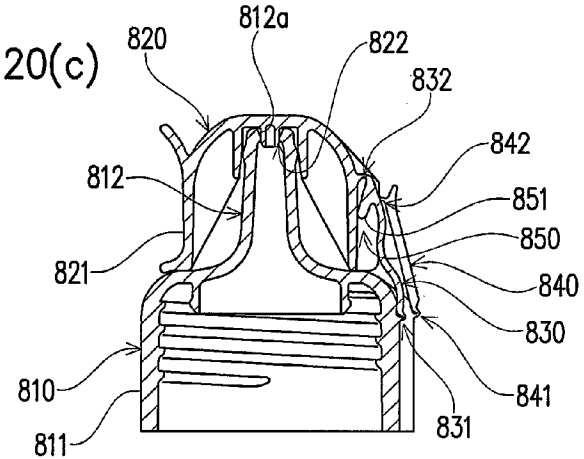
Figure 20D:
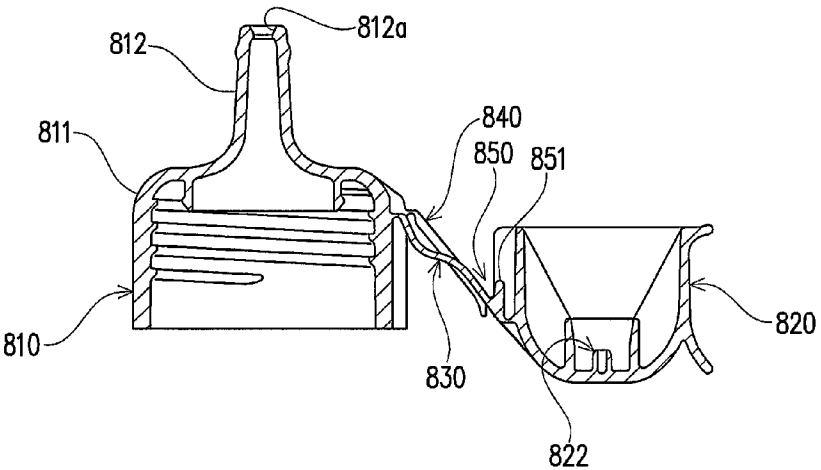

Now, the description will be made for a third embodiment of the cap and the container with the cap according to the present invention with reference to FIGS. 13-15. In FIGS. 13-15, parts or members, to which the same reference numerals are allocated, represent the same constructions or elements as those of the second embodiment.

The cap of this embodiment is made of resin (e.g., plastic). As shown in FIGS. 13 and 14, the cap includes a cap body 110 that has a pour spout opening 112*a*, a lid member 120 that is attached to and detached from the cap body 110 to open and close the pour spout opening 112*a*, an elastic member 130 that couples the lid member 120 to the cap body 110, and a pair of coupling members 140, 140 that couple the lid member 120 to the cap body 110.

Each coupling member 140 is connected to the cap body 110 via a first hinge mechanism 141, and is connected to the lid member 120 via a second hinge mechanism 142 having an axis parallel to the axis of the first hinge mechanism 141. The elastic member 130 is connected to the cap body 110 via a third hinge mechanism 131 having an axis parallel to the axes of the hinge mechanisms 141, 142.

The cap body 110 includes a circumferential wall portion 111 that is connected to the elastic member 130 and the coupling members 140, 140, and a pour spout portion 112 that has the pour spout opening 112*a* located at a position close to the first end of the circumferential wall portion 111. The cap body 110 includes an engaging stopper member 113 that engages with the coupling members 140, 140 when the lid member 120 is moved toward the cap body 110, and projecting engagement portions 114, 114, 114 that are located around the pour spout portion 112 to engage with the lid member 120 to fix the same when the lid member 120 closes the pour spout opening 112*a*.

The engaging stopper member 113 has a curved plate shape standing upright, and is configured to stop the coupling members 140, 140 from being pivotally moved by the first hinge mechanisms 141 beyond a predetermined angle. The engaging stopper member 113 includes a support part 113*a* at its leading end to support the second hinge mechanism 142 and thereby enable the lid member 120 to be easily pivotally moved by the second hinge mechanism 142.

The lid member 120 includes a housing 121 that has a cylindrical shape to house the pour spout portion 112, and a sealing part 122 that seals the pour spout opening 112*a*. The lid member 120 includes a connection piece 123 that radially projects from the housing 121 and connects with an elastic member 3 and coupling members 4, 4, and a flange part 124 to be operated when the lid member 120 is detached from the cap body 110. The housing 121 includes an engaged part 121*a* that radially inwardly projects to be engaged with the projecting engagement portions 114, 114, when the housing 121 houses the pour spout portion 112 and the projecting engagement portions 114, 114, 114.

The elastic member 130 has a band shape and a length greater than the coupling members 140, 140. The elastic member 130 and the coupling members 140, 140 are disposed to respectively have end portions, which are connected to the circumferential wall portion 111 of the cap body 110, located away from each other in the direction orthogonal to the axial direction of the hinge mechanisms 131, 141, 142.

The elastic member 130 is connected to the cap body 110 (circumferential wall portion 111) at a position closer to a second end of the cap body 110 than each coupling member 140 is. Specifically, each coupling member 140 is connected to the cap body 110 at a position closer to a first end (pour spout portion 112) of the cap body 110 than the elastic member 130 is. Whereby, the elastic member 130 is elastically deformed into a straight shape when the lid member 120 has been attached to the cap body 110, and restored into a curved shape to project inwardly when the lid member 120 has been detached from the cap body 110.

Each coupling member 140 has rigidity and formed into a band shape. The pair of the coupling members 140, 140 are aligned to each other with the elastic member 130 therebetween. Each coupling member 140 is elastically deformed into a linear shape so as to be located along the circumferential wall portion 111 when the lid member 120 has been attached to the cap body 110.

The cap and the container with the cap according to this embodiment have the configurations as described above, and now the description will be made for the function of the cap and the container with the cap according to this embodiment with reference to FIG. 15.

First, the description will be made for the case where the lid member 120 is detached from the cap body 110. As shown in FIG. 15(*a*), when the lid member 120 is attached to the cap body 110, the elastic member 130 is elastically deformed into a straight shape. The elastic member 130 and each coupling member 140 are located along the circumferential wall portion 111.

When the lid member 120 has been detached from the cap body 110, the elastic member 130 is restored into a curved shape to project inwardly or toward the cap body 110 (circumferential wall portion 111). Whereby, as shown in FIG. 15(*b*), the lid member 120 is pivotally moved by the second hinge mechanisms 142, while, at the same time, the elastic member 130 and the coupling members 140, 140 are integrally pivotally moved since the elastic member 130 pushes the circumferential wall portion 111.

Then, as shown in FIG. 15(*c*), the lid member 120, the elastic member 130 and the coupling members 140, 140 are integrally and pivotally moved away further from the cap body 110 due to the restoration force of the elastic member 130, which causes the elastic member to be restored entirely into a curved shape. As shown in FIG. 15(*d*), when the elastic member 130 has been restored into a curved shape, the elastic member 130 and the coupling members 140, 140 together hold the lid member 120 at a balanced position. That is, the elastic member 130 and the coupling members 140, 140 together hold the lid member 120 at a position at which the lid member 120 is located away from the cap body 110.

Now, the description will be made for the case where the lid member 120 is attached to the cap body 110. As shown in FIG. 15(*d*), when the lid member 120 is urged from the position at which the elastic member 130 and the coupling members 140, 140 together hold the lid member 120, the lid member 120, the elastic member 130 and the coupling members 140, 140 are integrally moved toward the cap body 110, as shown in FIG. 15(*c*).

Accordingly, as shown in FIG. 15(*b*), the engaging stopper member 113 engages with the coupling members 140, 140 to stop the coupling members 140, 140 from being pivotally moved by the first hinge mechanisms 141. When the lid member 120 is further urged, the lid member 120 is pivotally moved by the second hinge mechanisms 142 with the support part 113*a* of the locking member 113 kept supporting the second hinge mechanisms 142.

Accordingly, as shown in FIG. 15(*a*), the lid member 120 is attached to the cap body 110 with the elastic member 130, which has been elastically deformed into a straight shape, and the coupling members 140, 140 located along the circumferential wall portion 111.

As described above, according to the cap and the container with the cap of this embodiment, each coupling member 140 is connected to the cap body 110 via the first hinge mechanism 141 so that the lid member 120, the elastic member 130 and the coupling members 140, 140 are integrally moved toward and away from the cap body 110. Each coupling member 140 is connected to the lid member 120 via the second hinge mechanism 142 so that the lid member 120 is moved toward and away from the cap body 110.

Whereby, it is configured so that, when the lid member 120 has been attached to the cap body 110, each coupling member 140 is held at a position close to the cap body 110. Thus, when the elastic member 130 has been restored, the distance between the lid member 120 and the cap body 110 can be increased, while, at the same time, it is possible to prevent or reduce the increase in volume of the cap, when the lid member 120 has been attached to the cap body 110.

Furthermore, according to the cap and the container with the cap of this embodiment, each coupling member 140 is connected to the circumferential wall portion 111 of the cap body 110 at a position closer to a first end of the circumferential wall portion 111 than the elastic member 130 is. Whereby, the elastic member 130 can be elastically deformed into a straight shape when the lid member 120 has been attached to the cap body 110, and can be restored into a curved shape when the lid member 120 has been detached from the cap body 110.

The cap and the container with the cap according to the present invention are not necessarily limited to the above embodiments and it is a mater of course that they may be subjected to various modifications within the scope of the present invention. The structures of any of the above plural embodiments or methods may be arbitrarily employed (that is, the structure or method of one embodiment may be applied to the structure or method of another embodiment). Furthermore, it is matter of course that the structure or method of each of the various modified examples may be arbitrarily selected to be used as the structure or method of each of the above embodiments.

For the cap 1 and the container with the cap according to the first embodiment, the description was made by taking, for example, the case where the elastic members 30 is elastically deformed to elongate as the lid member 20 is moved away from the cap body 10. This is not essential. For example, as shown in FIGS. 16 and 17, an elastic member 301 may be elastically deformed to shrink as the lid member 20 is moved away from the cap body 10.

A cap as shown in FIGS. 16 and 17 includes the elastic member 301 that is connected to the cap body 10 via a third hinge mechanism 301*a* and connected to the lid member 20 via a fourth hinge mechanism 301*b*, and a pair of coupling members 401, 401 that are connected to the cap body 10 via a first hinge mechanism 401*a* and connected to the lid member 20 via a second hinge mechanism 401*b*. Furthermore, the cap includes a pivotal movement restraining device 501 that includes a pair of projections 501*a*, 501*b*, which restrains the lid member 20 from being moved close to the coupling members 401, 401 beyond a predetermined limit through pivotal movement by the second hinge mechanism 401*b*.

The elastic member 301 and the coupling members 401, 401 are disposed to have their end portions, which are connected to the cap body 10, located away from each other in the direction orthogonal to the axial direction of the hinge mechanisms 301*a*, 401*a*. Specifically, each coupling member 401 is connected to the cap body 10 at a position closer to a second end (lower end) of the cap body 10 in the axial direction of the cap body 10 than the elastic member 301 is, and closer to the axis of the cap body 10 in the radial direction of the cap body 10 than the elastic member 301 is.

The elastic member 301 and the coupling members 401, 401 are disposed to have their ends, which are connected to the lid member 20, located away from each other in the direction orthogonal to the axial direction of the hinge mechanisms 301*b*, 401*b*. Specifically, each coupling member 401 is connected to the lid member 20 at a position closer to a first end of the lid member 20 in the axial direction of the lid member 20 than the elastic member 301 is, and closer to the axis of the lid member 20 in the radial direction of the lid member 20 than the elastic member 301 is. The function of the thus configured cap will be hereinafter described with reference to FIG. 17.

First, as shown in FIG. 17(*a*), with the lid member 20 attached to the cap body 10, the elastic member 301 is kept in a curved shape. At this moment, the elastic member 301 is not elastically deformed due to the existence of the third and fourth hinge mechanisms 301*a*, 301*b*. Then, as shown in FIG. 17(*b*), when the lid member 20 is detached from the cap body 10, the elastic member 301 is elastically deformed to shrink, and then each coupling member 401 is pivotally moved by the first hinge mechanism 401*a* so that the lid member 20 is moved away from the cap body 10.

Accordingly, along with the movement of the lid member 20 away from the cap body 10, as shown in FIG. 17(*c*), the elastic member 301 is further elastically deformed to shrink. Then, when the elastic member 301 is elastically deformed beyond a predetermined limit, the elastic member 301 is restored by elastic force or deformed to elongate, thereby urging the lid member 20. Thus, the lid member 20 is held away from the cap body 10. As shown in FIG. 17(*d*), when the elastic member 301 has been restored, the elastic member 301 and the coupling members 401, 401 together hold the lid member 20 at a balanced position at which the lid member 20 is located away from the cap body 10.

For the cap 1 and the container with the cap according to the first embodiment, the description was made by taking, for example, the case where the elastic members 30 and the coupling member 40 are disposed to have their ends, which are connected to the lid member 20, located away from each other in the direction orthogonal to the axial direction of the hinge mechanisms 32, 42. This is not essential. For example, as shown in FIGS. 18 and 19, elastic members 730, 730 and a coupling member 740 may be disposed to have their ends, which are connected to a lid member 720, located at the same position in the direction orthogonal to the axial direction of the hinge mechanisms 732, 742.

The cap shown in FIGS. 18 and 19 includes a pair of elastic members 730, 730 that are connected to the cap body 710 via a third hinge mechanism 731 and connected to the lid member 720 via a fourth hinge mechanism 732, and a coupling member 740 that is connected to the cap body 710 via a first hinge mechanism 741 and connected to the lid member 720 via a second hinge mechanism 742. Furthermore, the cap includes a pivotal movement restraining device 750 that includes a pair of projections 751, 752 in order to restrain the lid member 720 from being moved close to the coupling member 740 beyond a predetermined limit through further pivotal movement by the second hinge mechanism 742.

The elastic members 730, 730 and the coupling member 740 are disposed to have their ends, which are connected to the cap body 710, located away from each other in the direction orthogonal to the axial direction of the hinge mechanisms 731, 741. Specifically, each elastic member 730 is connected to the cap body 710 at a position closer to the second end (lower end) of the cap body 710 in the axial direction of the cap body 710 than the coupling member 740 is, and closer to the axis of the cap body 710 in the radial direction of the cap body 710 than the coupling member 740 is. The function of the thus configured cap will be hereinafter described with reference to FIGS. 18 and 19.

First, as shown in FIGS. 18(*a*) and 18(*b*), with the lid member 720 attached to the cap body 710, the elastic member 730 is kept in a curved shape. At this moment, the elastic members 730, 730 are not elastically deformed due to the existence of the third and fourth hinge mechanisms 731, 732. Then, as shown in FIGS. 18(*c*) and 18(*d*), the lid member 720 is detached from the cap body 710, and the lid member 720 is pivotally moved by the second and fourth hinge mechanisms 742, 732 so that the cap body 710 is moved away from the cap body 710.

At this moment, as shown in FIG. 19(*a*), the lid member 720 is pivotally moved by the second and fourth hinge mechanisms 742, 732, while each elastic member 730 is not elastically deformed before the pair of the projections 751, 752 of the pivotal movement restraining device 750 abut each other. When the pair of the projections 751, 752 abut each other, the lid member 720 and the coupling member 740 are pivotally moved by the first hinge mechanism 741. Accordingly, along with the movement of the lid member 720 away from the cap body 710, each elastic member 730 is elastically deformed to elongate.

Furthermore, as shown in FIG. 19(*b*), when each elastic member 730 has been elastically deformed to elongate into a straight shape, each elastic member 730 is restored by elastic force or deformed to shrink, thereby urging the lid member 720, so that the lid member 720 is held away from the cap body 710. Then, as shown in FIGS. 19(*c*) and 19(*d*), when each elastic member 730 has been restored, the elastic members 730, 730 and the coupling member 740 together hold the lid member 720 at a balanced position at which the lid member 720 is located away from the cap body 710.

For the cap 1 and the container with the cap according to the first embodiment, the description was made by taking, for example, the case where the pair of the elastic members 30, 30 are located with the one coupling member 40 therebetween. This is not essential. For example, one elastic member, or three or more elastic members may be provided. Or, two or more coupling members may be provided.

For the cap 1 and the container with the cap according to the first embodiment, the description was made by taking, for example, the case where the width of the elastic members 30, 30 is smaller than the width of the coupling member 40. This is not essential. For example, the width of the elastic member may be greater than the width of the coupling member. Or, the width of the elastic member may be equal to the width of the coupling member.

For the cap 1 and the container with the cap according to the first embodiment, the description was made by taking, for example, the case where the pour spout opening 12 is an opening end located at a position close to the first end of the cylindrical circumferential wall portion 11. This is not essential. For example, as shown in FIGS. 18-19 and FIG. 20, a pour spout opening 712*a* or 812*a* may be located at a distal end portion of a pour spout portion 712 or 812, which projects from the first end of a circumferential wall portion 711 or 811.

In each of the caps shown in FIGS. 18-19 and FIG. 20, the lid member 720 or 820 is attached to the cap body 710 or 810 so that the pour spout portion 712 or 812 is housed in a lid body 721 or 821, and the pour spout opening 712*a* or 812*a* is sealed by a sealing part 722 or 822.

For the cap 1 and the container with the cap according to the first embodiment, the description was made by taking, for example, the case where, when the lid member 20 is detached from the cap body 10, the flange portion 24 of the lid member 20 is operated. This is not essential.

For example, as shown in FIGS. 18 and 19, it is possible to employ a configuration, in which an engaging stopper member 715 engages with a engaged member 725 in order to allow the lid member 720 to be fixed to the cap body 710. From this position, operational portions 716, 716 of the cap body 710 are pressed, thereby displacing the cap body 710 and the lid member 720 relative to each other and thus enabling the engaging stopper member 715 and the engaged member 725 to be brought into a position, where they are released from engagement with each other. The function of the thus configured cap will be hereinafter described with reference to FIG. 18.

Specifically, as shown in FIGS. 18(*a*) and 18(*b*), with the engaged member 725 held in engagement with the engaging stopper member 715, a pair of the operational portions 716, 716 coupled to the circumferential wall portion 711 of the cap body 710 are radially inwardly pressed, which causes elastic deformation of the operational portions 716, 716. Whereby, guide portions 717, 717, which have a tapered shape projecting from each operational portion 716, guide guided portions 726, 726, which have a tapered shape projecting from the lid member 720.

Accordingly, as shown in FIGS. 18(*c*) and 18(*d*), the lid member 720 is displaced upward relative to the cap body 710. Whereby, the engaged member 725 is displaced relative to the engaging stopper member 715, thus enabling the engaged member 725 to be switched into a position, where the engaged member 725 is released from engagement with the engaging stopper member 715. Providing of the two operation portions 716, 716 is not necessarily, while it is possible to provide only one operational portion 716.

For the cap 1 and the container with the cap according to the above first embodiment, the description was made by taking, for example, the case where the elastic members 30 is elastically deformed into a straight shape, while being restored into a curved shape (specifically, a curved shape having one concave or convex, that is, an arc shape). This is not essential. For example, an elastic member may be elastically deformed into a curved shape having plural recesses and projections, while being restored into a straight shape by elastic force. Also, as shown in FIG. 20, an elastic member 830 is elastically deformed into a straight shape, while being elastically restored into a wave shape having plural recesses and projections by elastic force.

For the cap 1 and the container with the cap according to the above first embodiment, the description was made by taking, for example, the case where the first pivotal movement restraining device 50 includes the projection 501 that projects from the lid member 20 and the projection 502 that projects from the coupling member 40; and the second pivotal movement restraining device 51 includes the projection 511 that projects from the lid member 20. This is not essential.

For example, as shown in FIG. 20, a pivotal movement restraining device 850 may include a projection 851 that projects from the elastic member 830. According to this configuration, the projection 851 abuts a lid member 820 to restrain the lid member 820 from being moved close to a coupling member 840 beyond a predetermined limit through pivotal movement by a second hinge mechanism 842. Furthermore, the hinge mechanisms each are formed by reducing the thickness of the corresponding end portion of each of the elastic member 30 and the coupling member 40, which are made of resin. Thus, for example, it is possible to employ a configuration, in which each hinge mechanism has elastic force so that each hinge mechanism itself possesses a pivotal movement restraining function by elastic force.

For the cap 1 and the container with the cap according to the above first embodiment, the description was made by taking, for example, the case where each elastic member 30 is not elastically deformed when the lid member 20 has been attached to the cap body 10. This is not essential. For example, as shown in FIGS. 20(*a*) and 20(*c*), the elastic member 830 may be slightly elastically deformed to such an extent as not to cause plastic deformation, by abutment of the lid member 820 with the projection 851 of the pivotal movement restraining device when the lid member 820 has been attached to the cap body 810.

Figure 21A:
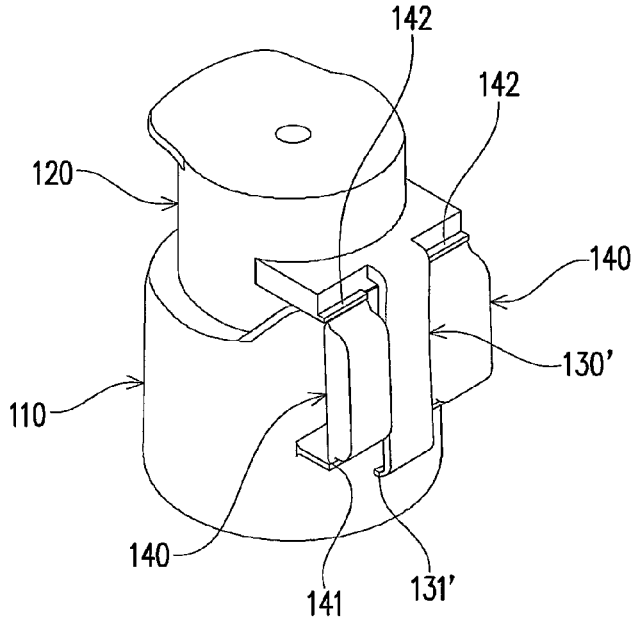
FIG. 21 are overall views of a cap according to yet another embodiment of the present invention, and specifically, FIG. 21(*a*) is a perspective view with a lid member held in closed position, and FIG. 21(*b*) is a perspective view with the lid member held in open position.
Figure 21B:
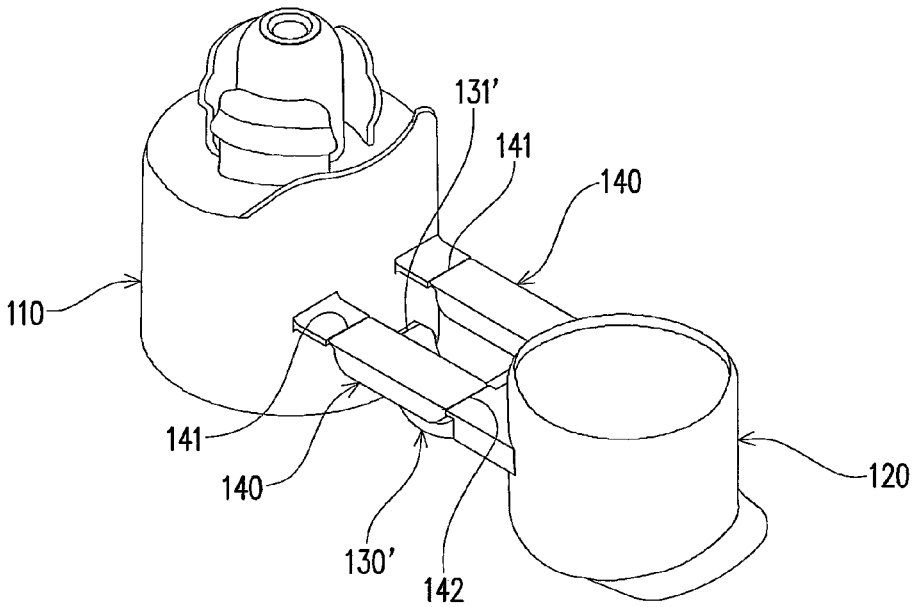
Figure 22B:
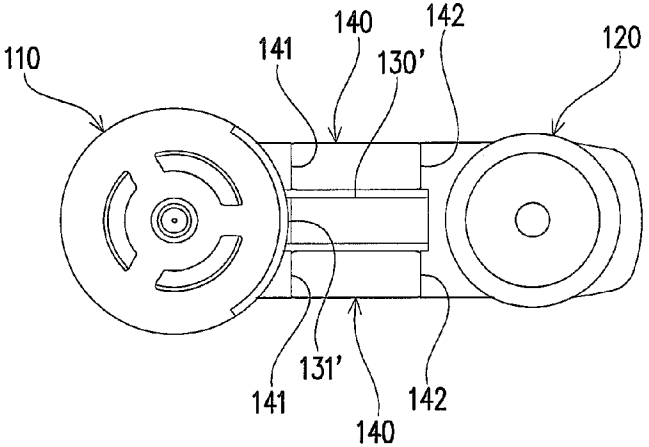
FIG. 22 are overall views of the cap according to this embodiment, and specifically, FIG. 22(*a*) is a plan view with the lid member held in closed position, FIG. 22(*b*) is a plan view with the lid member held in open position, FIG. 22(*c*) is a front view with the lid member held in closed position, and FIG. 22(*d*) is a front view with the lid member held in open position.
Figure 22D:
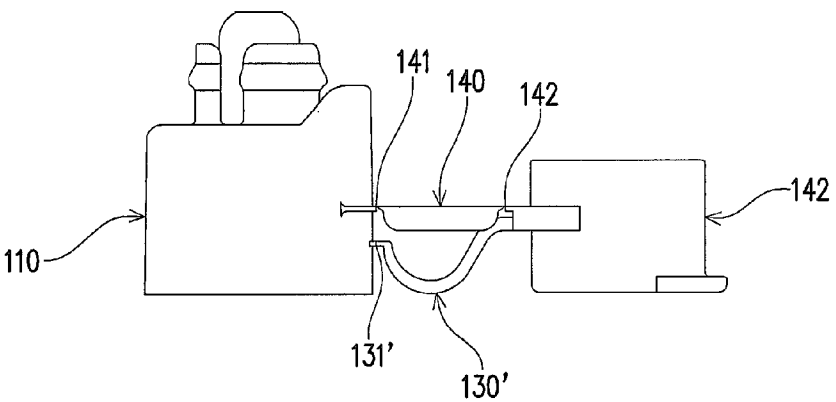
Figure 22A:
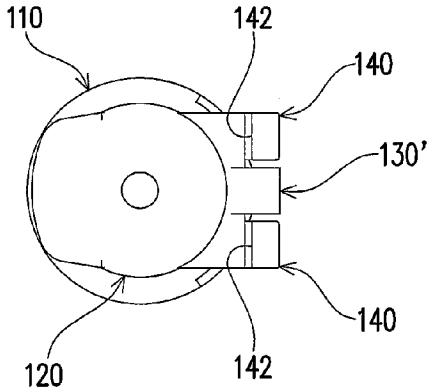
Figure 22C:
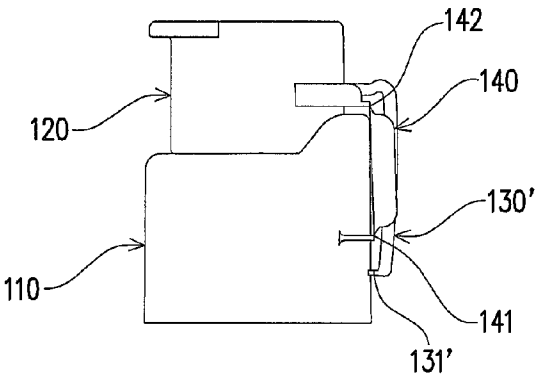
Figure 23B:
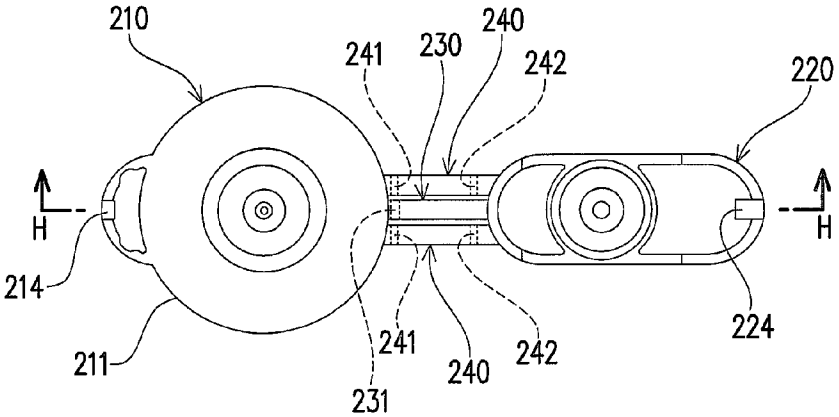
FIG. 23 are overall views of a cap according to another embodiment of the present invention, and specifically, FIG. 23(*a*) is a plan view with a lid member held in closed position, FIG. 23(*b*) is a plan view with the lid member held in open position, FIG. 23(*c*) is a front view with the lid member held in closed position, and FIG. 23(*d*) is a front view with the lid member held in open position.
Figure 23D:
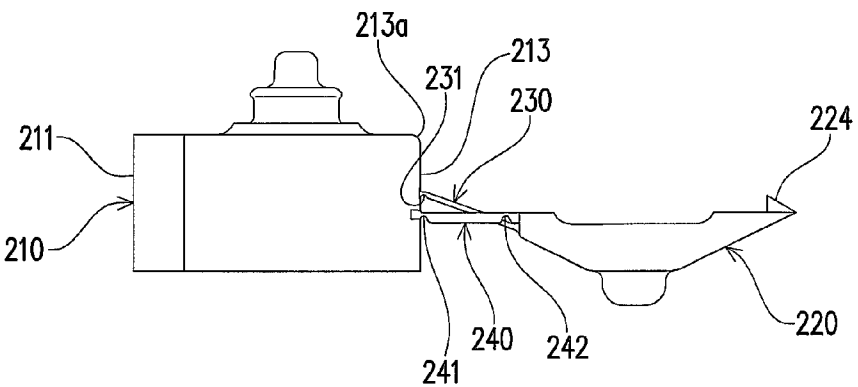
Figure 23A:
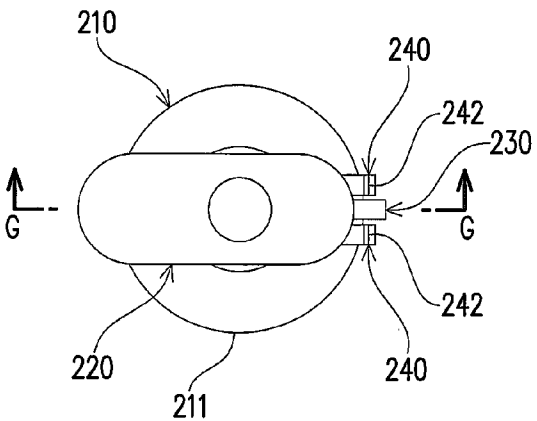
Figure 23C:
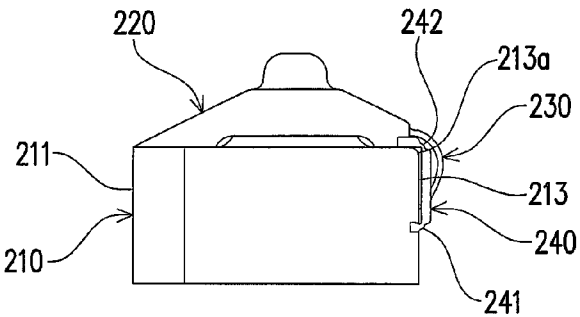

For the cap and the container with the cap according to the above third embodiment, the description was made by taking, for example, the case where the elastic member 130 is restored into a curved shape to project inwardly when the lid member 120 has been detached from the cap body 110. This is not essential. Specifically, as shown in FIGS. 21 and 22, it is possible to employ a configuration, in which an elastic member 130' is connected to the cap body 110 via a hinge mechanism 131', and is restored into a curved shape to project outwardly when the lid member 120 has been detached from the cap body 110.

For the cap and the container with the cap according to each of the second and third embodiments, the description was made by taking, for example, the case where the elastic member 300 or 130 and the coupling member 400 or 140 are disposed to have their ends, which are connected to the cap body 100 or 110, located away from each other in the direction orthogonal to the axial direction of the hinge mechanisms 300*a*, 400*a*, 400*b*, or 131, 141, 142, and have their ends, which are connected to the lid member 200 or 120, located at the same position in the direction orthogonal to the axial direction of the hinge mechanism 300*a*, 400*a*, 400*b*, or 131, 141, 142.

For example, an elastic member and a coupling member may be disposed to have their first ends matched in position to their second ends, or may be disposed to have their first ends matched in position to each other, while having second ends located away from each other. In a case where the first ends are matched in position to the second ends, an elastic member is preferably connected to the cap body and the lid member without a hinge mechanism.

Figure 24B:
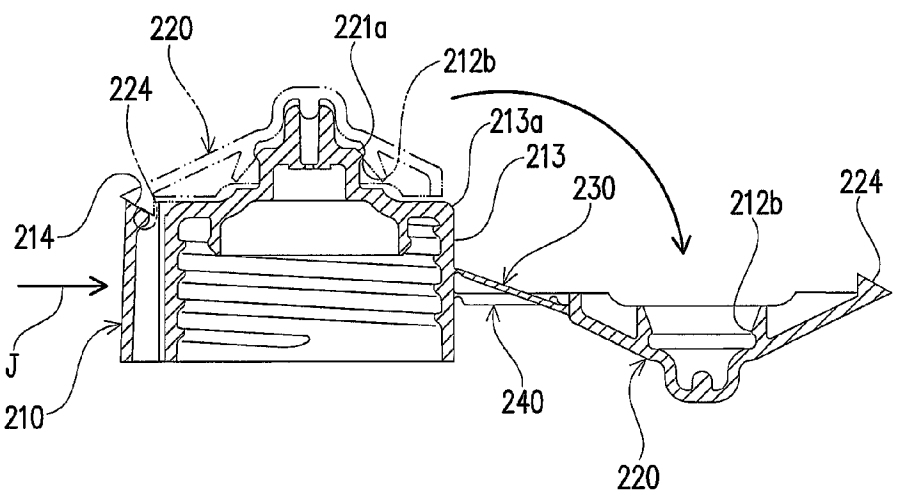
FIG. 24 are overall views of the cap according to this embodiment, and specifically, FIG. 24(*a*) is a cross sectional view taken along a line G-G in FIG. 23(*a*), and FIG. 24(*b*) is a cross sectional view taken along a line H-H in FIG. 23(*b*).
Figure 24A:
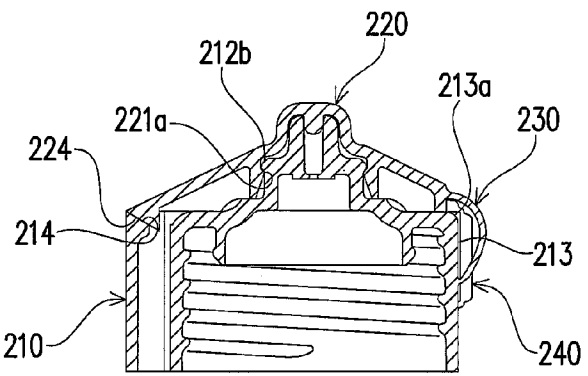
Figure 25B:
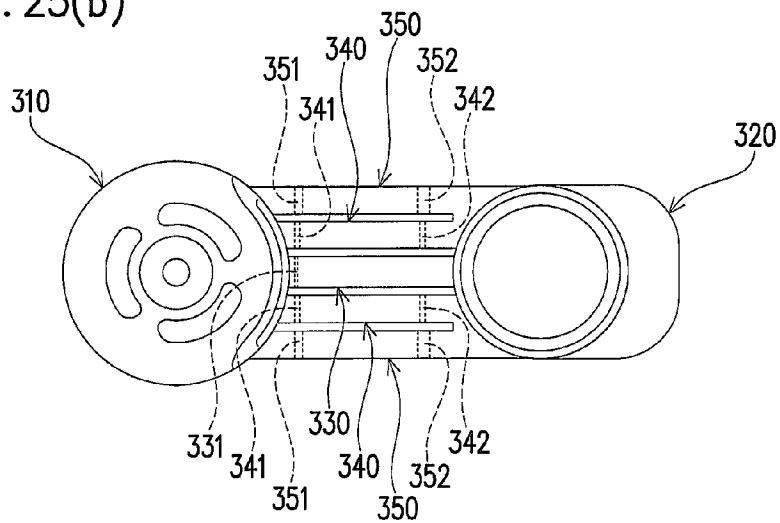
FIG. 25 are overall views of a cap according to still another embodiment of the present invention, and specifically, FIG. 25(*a*) is a plan view with the lid member held in closed position, FIG. 25(*b*) is a plan view with the lid member held in open position, FIG. 25(*c*) is a front view with the lid member held in closed position, and FIG. 25(*d*) is a front view with the lid member held in open position.
Figure 25A:
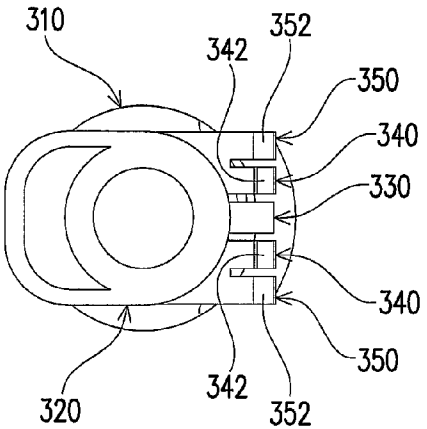
Figure 25D:
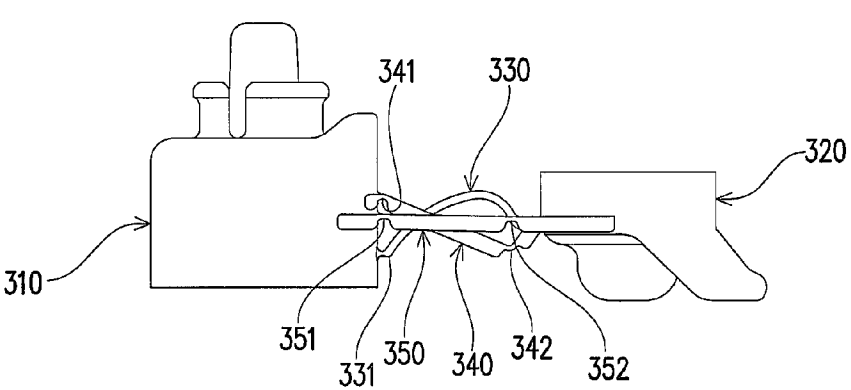
Figure 25C:
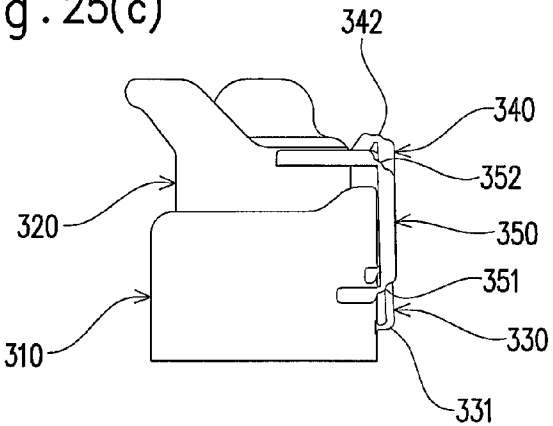
Figure 26B:
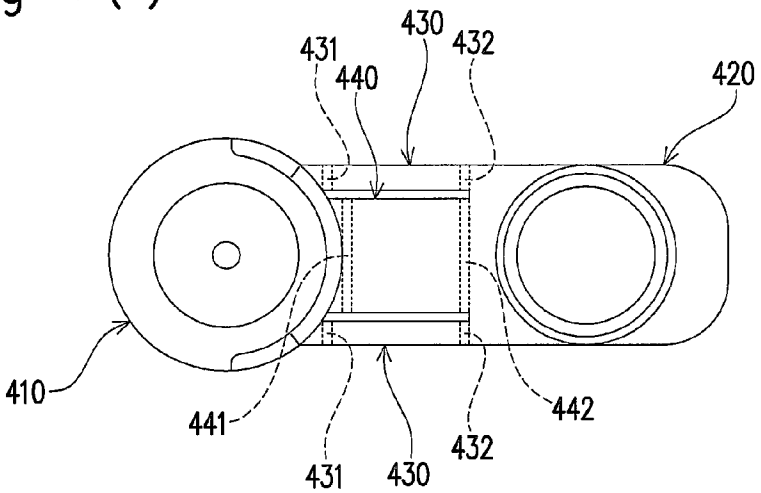
FIG. 26 are overall views of a cap according to yet another embodiment of the present invention, and specifically, FIG. 26(*a*) is a plan view with a lid member held in closed position, FIG. 26(*b*) is a plan view with the lid member held in open position, FIG. 26(*c*) is a front view with the lid member held in closed position, and FIG. 26(*d*) is a front view with the lid member held in open position.
Figure 26D:
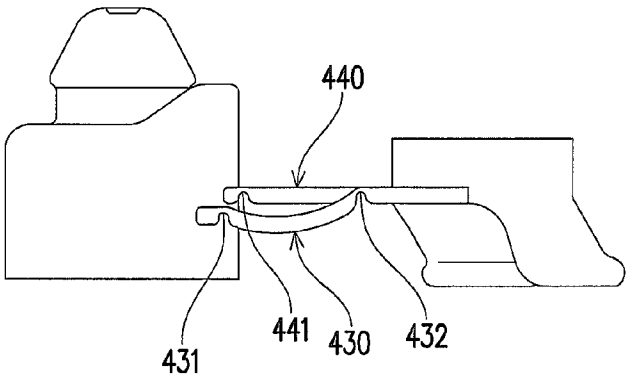
Figure 26A:
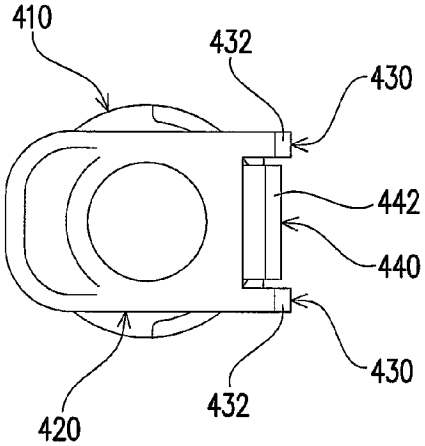
Figure 26C:
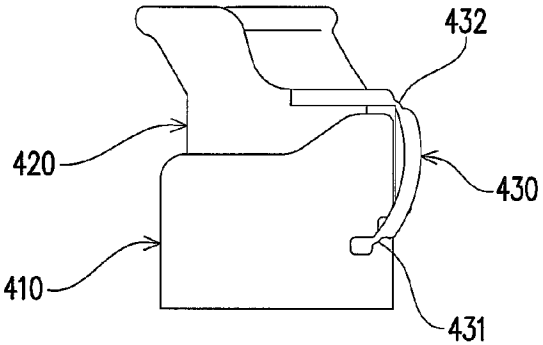

Furthermore, as shown in FIGS. 23 and 24, an elastic member 230 and each coupling member 240 may be disposed to have not only first ends, which are connected to a cap body 210, located away from each other in the direction orthogonal to the cap body 210, but also second ends, which are connected to a lid member 220, located away from each other in the direction orthogonal to hinge mechanisms 231, 241, 242. According to the thus configured cap, a circumferential wall portion 211 of the cap body 210 functions as an engaging part 213, while an upper end of the circumferential wall portion 211 (engaging part 213) functions as a support part 213*a*.

In addition, as shown in FIG. 25, it is possible to employ a configuration, in which there are provided an elastic member 330, a pair of first coupling members 340, 340 aligned to each other with the elastic member 330 therebetween, and a pair of second coupling members 350, 350 aligned to each other with the first coupling members 340, 340 therebetween, in which the first coupling members 340, 340 and the second coupling members 350, 350 are disposed to have not only their first ends, which are connected to the cap body 310, but also the second ends, which are connected to the lid member 320, located away from each other in the direction orthogonal to the hinge mechanisms 331, 341, 342, 351, 352.

For the cap and the container with the cap according to each of the above second and third embodiments, the description was made by taking, for example, the case where the elastic members 300 or 130 and the coupling member 400 or 140 have the same width. This is not essential. For example, the elastic member may have a width greater than the width of the coupling member. Also, as shown in FIG. 26, a coupling member 440 that couples a lid member 420 to a cap body 410 may have a width greater than the width of elastic members 430, 430. The elastic members 430, 430 and the coupling member 440 may be provided at their first and second ends with hinge mechanisms 431, 432, 441, 442.

For the cap and the container with the cap according to each of the above second and third embodiments, the description was made by taking, for example, the case where the pair of the coupling members 400, 400, or 140, 140 are aligned to each other with the elastic member 300 or 130 therebetween. This is not essential. For example, as shown in FIG. 26, a pair of elastic members 430, 430 may be aligned to each other with a coupling member 440 therebetween. In summary, no limitation is intended to the number of elastic members or coupling members, and the arrangements thereof.

Figure 27B:
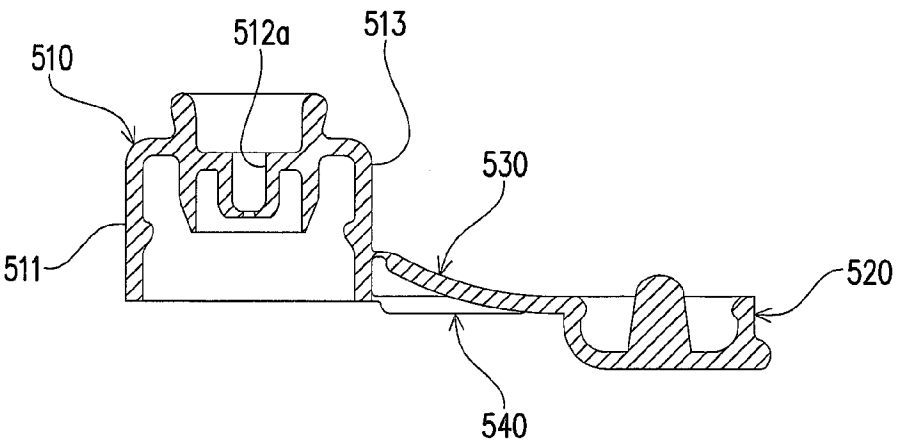
FIG. 27 are overall views of a cap according to another embodiment of the present invention, and specifically, FIG. 27(*a*) is a vertically cross sectional view with a 1*d* member held in closed position and FIG. 27(*b*) is a vertically cross sectional view with the lid member held in open position.
Figure 27A:
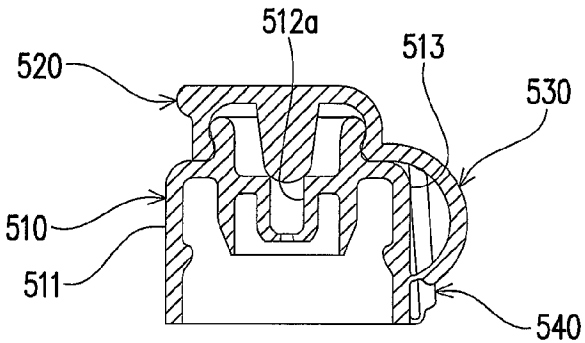

For the cap and the container with the cap according to each of the above second and third embodiments, the description was made by taking, for example, the case where the pour spout portion 102 or 112 projects from the circumferential wall portion 101 or 111. This is not essential. As shown in FIG. 27, a cap body 510 may be configured so that a pour spout opening 512*a* is located at a first end of a circumferential wall portion 511. That is, the pour spout opening 512*a* may not be located at a projecting pour spout portion.

As shown in FIG. 27(*a*), the pour spout opening 512*a* is sealed by a lid member 520 that is coupled to the cap body 510 via an elastic member 530 and a coupling member 540. In the thus configured cap, the circumferential wall portion 511 of the cap body 510 functions as an engaging stopper member 513.

For the cap and the container with the cap according to each of the above second and third embodiments, the description was made by taking, for example, the case where the flange part 204 or 124 of the lid member 200 or 120 is operated when the lid member 200 or 120 is detached from the cap body 100 or 110. This is not essential.

For example, as the cap explained with reference to FIGS. 23 and 24, it may be configured so that the circumferential wall portion 211 of the cap body 210 is pressed in a state where an engaged part 221*a* is engaged with an engaging part 212*b* of the cap body 210, thereby causing the cap body 210 to be displaced relative to the lid member 220 to bring the engaging part 212*b* to a position at which it releases the engaged part 221*a* from the engagement therewith.

Specifically, as shown in FIG. 24, with the engaged part 221*a* engaged with the engaging part 212*b*, when the circumferential wall portion 211 of the cap body 210 is pressed radially inwardly (in a direction represented by an arrow J in FIG. 24(*a*)), the circumferential wall portion 211 of the cap body 210 is deformed. Whereby, a guide portion 214 that has a tapered shape projecting from the cap body 210 guides a guided portion 224 that has a tapered shape projecting from the lid member 220. Thus, the lid member 220 is displaced upward relative to the cap body 210.

Accordingly, the engaging part 212*b* is displaced relative to the engaged part 221*a* so that the engaging part 212*b* is brought into a position at which it releases the engaged part 221*a* from the engagement therewith. Thus, as shown in FIG. 24(*b*), the elastic member 230, which has been elastically deformed, is restored, and the lid member 220 is moved away from the cap body 210, which is coupled to the lid member 220 via the coupling members 240.

Figure 28B:
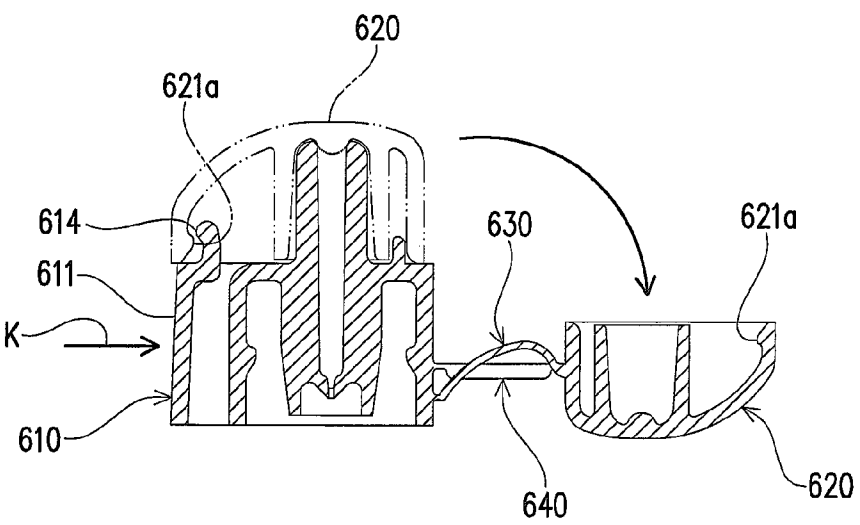
FIG. 28 are overall views of a cap according to still another embodiment of the present invention, and specifically, FIG. 28(*a*) is a vertically cross sectional view with a lid member held in closed position and FIG. 28(*b*) is a vertically cross sectional view with the lid member held in open position.
Figure 28A:
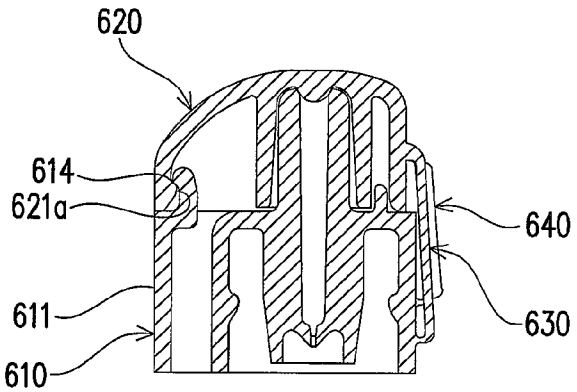

Furthermore, as shown in FIG. 28, it is possible to employ a configuration, which enables switching the operational position into a position at which an engaging part 614 of a cap body 610 engages with an engaged part 621*a* of a lid member 620, and into a position at which the engaging part 614 releases the engaged part 621*a* from the engagement therewith by the displacement of the engaging part relative to the engaged part 621*a*.

Specifically, as shown in FIG. 28(*a*), with the engaged part 621*a* engaged with the engaging part 614, when a circumferential wall portion 611 of a cap body 610 is pressed radially inwardly (in a direction represented by an arrow K in FIG. 28(*a*)), the circumferential wall portion 611 of the cap body 610 is deformed. Whereby, the engaging part 614 is displaced relative to the engaged part 621*a* so that the engaging part 614 is switched into a position at which it releases the engaged part 621*a* from the engagement therewith. Thus, as shown in FIG. 28(*b*), an elastic member 630, which has been elastically deformed, is restored and the lid member 620 is moved away from the cap body 610, to which the lid member 620 is coupled via a coupling member 640.

For the cap and the container with the cap according to each of the above second and third embodiments, the description was made by taking, for example, the case where the elastic member 300 is elastically deformed into a curved shape (specifically, a curved shape having one concave or convex) and restored into a straight shape. Also, for the cap and the container with the cap according to the third embodiment, the description was made by taking, for example, the case where the elastic member 130 is elastically deformed into a straight shape and restored into a curved shape. These are not essential. For example, an elastic member may be elastically deformed into a curved shape such as a wave shape having plural concaves and convexes or restored into such a shape, and furthermore, an elastic member may be elastically deformed and restored into such a shape.

For the cap 1 and the container with the cap according to each of the above first to third embodiments, the description was made by taking, for example, the case where the coupling member 40, 400 or 140 has a straight shape. This is not essential. For example, a coupling member may have a curved shape or arc shape. In summary, a coupling member essentially has rigidity so as not to be deformed even when it is pivotally moved by each hinge mechanism, or a lid member is detached from a cap body.

For the cap 1 and the container with the cap according to each of the above first to third embodiments, the description was made by taking, for example, the case where the hinge mechanisms 31, 32, 41, 42, 300*a*, 400*a*, 400*b*, or 131, 141, 142 are formed by reducing the thickness of corresponding end portions of the elastic member 30, 300 or 130, or corresponding end portions of the coupling member 40, 400 or 140. This is not essential. For example, each hinge mechanism may be achieved by employing a separate hinge member (a hinge).

For the container with the cap according to each of the above first to third embodiments, the description was made by taking, for example, the case where the cap 1 is made of resin or plastic. This is not essential. For example, a cap may be entirely made of metal, or formed by combining plural materials together. Especially, an elastic member is preferably made of a material (e.g., liquid crystal plastic), which has a large elastic force (restoration force) to be exerted when the elastic member has been elastically deformed, and is unlikely to cause plastic deformation when the elastic member has been elastically deformed.

For the container with the cap according to each of the above first to third embodiments, the description was made by taking, for example, the case where the container 9 is made of resin or plastic. This is not essential. For example, a container may be made of glass or metal (e.g., aluminium or steel).

For the container with the container with the cap according to the above first embodiment, the description was made by taking, for example, the case where the cap 1 is formed integrally with the container 9. For the container with the cap according to each of the above second and third embodiments, the description was made by taking, for example, the case where the cap is detachably attached to the container by the screw mechanism. This is not essential. For example, a cap may be detachably attached to a container by a different fixing means, or a cap may be configured so as not to be detached once the cap has been fixed to the container.

Description Of Reference Numbers

1: cap, 9: container, 10: cap body, 20: lid member, 30: elastic member, 40: coupling member, 12: pour spout, 31: third hinge mechanism, 32: fourth hinge mechanism, 41: first hinge mechanism, 42: second hinge mechanism, 50: first pivotal movement restraining device, 51: second pivotal movement restraining device, 103: engaging stopper member, 103*a*: support part

The invention claimed is:

1. A cap comprising a cap body that is fixed to a container and has a pour spout opening, through which content of the container is poured out, a lid member that is attached to and detached from the cap body to open and close the pour spout opening, and an elastic member that couples the lid member to the cap body, wherein:

the elastic member, which has been elastically deformed, is restored during at least part of the movement of the lid member away from the cap body, thereby enabling the lid member to he held away from the cap body;

the elastic member is elastically deformed when the lid member has been attached to the cap body, and restored when the lid member has been detached from the cap body, thereby enabling the lid member to he held away from the cap body;

the cap further comprising a coupling member that couples the lid member to the cap body, the coupling member being connected to the cap body via a first hinge mechanism and connected to the lid member via a second hinge mechanism that has an axis parallel to an axis of the first hinge mechanism; and the elastic member is connected to the cap body, both during attachment of the lid member to the cap body and during detachment of the lid member from the cap body, via a third hinge mechanism and connected to the lid member without the hinge mechanisms.

2. The cap according to claim 1, wherein the elastic member and the coupling member are disposed to have their ends, which are connected to the cap body, located away from each other in the direction orthogonal to the axial direction of the hinge mechanisms.

3. The cap according to claim 2, wherein the pour spout opening is disposed at a position close to a first end of the cap body, and the elastic member is connected to the cap body at a position closer to the first end of the cap body than the coupling member is.

4. The cap according to claim 2, wherein the pour spout opening is disposed at a position close to a first end of the cap body, and the coupling member is connected to the cap body at a position closer to the first end of the cap body than the elastic member is.

5. The cap according to claim 1, wherein the cap body includes an engaging stopper member that engages with the coupling member in order to stop the coupling member from being, pivotally moved by the first hinge mechanism, when the lid member is moved close to the cap body, and the engaging stopper member includes a support part that supports the second hinge mechanism with the coupling member held in engagement with the engaging stopper member.

6. A cap comprising a cap body that is fixed to a container and has a pour spout opening, through which content of the container is poured out, a lid member that is attached to and detached from the cap body to open and close the pour spout opening, and an elastic member that couples the lid member to the cap body, wherein:

the elastic member, which has been elastically deformed, is restored during at least part of the movement of the lid member away from the cap body, thereby enabling the lid member to be held away from the cap body;

the cap further includes a coupling member that couples the lid member to the cap body, the coupling member being connected to the cap body via a first hinge mechanism and connected to the lid member via at second hinge mechanism that has an axis parallel to an axis of the first hinge mechanism:

the elastic member is elastically deformed as the lid member is detached and moved away from the cap body, and restored when the elastic member is elastically deformed, thereby enabling the lid member to be held away from the cap body;

the elastic member is connected to the cap body, both during attachment of the lid member to the cap body and during detachment of the lid member from the cap body, via a third hinge mechanism that has an axis parallel to the axis of the hinge mechanisms and connected to the lid member via at fourth hinge mechanism that has an axis parallel to an axis of the third hinge mechanism, in order to restrain the elastic member from being elastically deformed when the lid member has been attached to the cap body;

the elastic member and the coupling member are disposed to have their ends, which are connected to the lid member, located away from each other in the direction orthogonal to the axial direction of the hinge mechanisms;

the cap further includes a pivotal movement restraining device that restrains the lid member from being moved close to the coupling member through pivotal movement by the second hinge mechanism in order to allow the lid member to he fixed by the elastic member and the coupling member;

the pivotal movement restraining device includes first and second pivotal movement restraining devices that restrain the lid member from being moved close to the coupling member through pivotal movement by the second hinge mechanism in order to allow the lid member to he fixed by the elastic member and the coupling member:

the first pivotal movement restraining device includes a pair of projections that are located adjacent to each other with the second hinge mechanism therebetween and project outwardly from the lid member and the coupling member, respectively, and one of the pair of projections has a plate shape projecting from an end portion of the lid member, and the other one of the pair of projections has a plate shape projecting from an end portion of the coupling member;

the second pivotal movement restraining device includes a projection that projects inwardly from the lid member;

the elastic member has a band shape; and the elastic member is deformed into a curved shape when the lid member has been attached to the cap body, and deformed to elongate when the lid member has been held away from the cap body.

7. A container with a cap comprising a container that contains content and a cap that fixed to the container, wherein:

the cap includes a cap heady that has a pour spout opening, through which the content of the container is poured out, a lid member that is attached to and detached from the cap body in order to open and close the pour spout opening, an elastic member that couples the lid member to the cap body, and a coupling member that couples the lid member to the cap body;

the elastic member, which has been elastically deformed, is restored during at least part of the movement of the lid member away from the cap body, thereby enabling the lid member to he held away from the cap body; and the coupling member is connected to the cap body via a first hinge mechanism and connected to the lid member via a second hinge mechanism that has an axis parallel to an axis of the first hinge mechanism;

the elastic member is elastically deformed as the lid member is detached and moved away from the cap body, and restored when the elastic member is elastically deformed, thereby enabling the lid member to he held away from the cap body;

the elastic member is connected to the cap body, both during attachment of the lid member to the cap body and during detachment of the lid member from the cap body, said connection being, via a third hinge mechanism that has an axis parallel to the axis of the hinge mechanisms and connected to the lid member via a fourth hinge mechanism that has an axis parallel to an axis of the third hinge mechanism, in order to restrain the elastic member from being elastically deformed when the lid member has been attached to the cap body;

the elastic member and the coupling member arc disposed to have their ends, which are connected to the lid member, located away from each other in the direction orthogonal to the axial direction of the hinge mechanisms;

the cap further includes a pivotal movement restraining device that restrains the lid member from being moved close to the coupling member through pivotal movement by the second hinge mechanism in order to allow the lid member to be fixed by the elastic member and the coupling member;

the pivotal movement restraining device includes first and second pivotal movement restraining devices that restrain the lid member from being moved close to the coupling member through pivotal movement by the second hinge mechanism in order to allow the lid member to be fixed by the elastic member and the coupling member:

the first pivotal movement restraining device includes a pair of projections that are located adjacent to each other with the second hinge mechanism therebetween, and project outwardly from the lid member and the coupling member, respectively, and one of the pair of projections has a plate shape projecting from an end portion of the lid member, and the other one of the pair of projections has a plate shape projecting from an end portion of the coupling member;

the second pivotal movement restraining device includes a projection that projects inwardly from the lid member;

the elastic member has a band shape; and the elastic member is deformed into a curved shape when the lid member has been attached to the cap body, and deformed to elongate when the lid member has been held away from the cap body.

* * * * *